US007141346B2

(12) United States Patent
Teraoka et al.

(10) Patent No.: US 7,141,346 B2
(45) Date of Patent: Nov. 28, 2006

(54) LIQUID DEVELOPER FOR IMAGE FORMING APPARATUS

(75) Inventors: Tsutomu Teraoka, Kanagawa (JP); Tsutomu Sasaki, Kanagawa (JP); Tsuneo Kurotori, Tokyo (JP); Masahiko Itaya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 246 days.

(21) Appl. No.: 10/803,952

(22) Filed: Mar. 19, 2004

(65) Prior Publication Data

US 2004/0241567 A1 Dec. 2, 2004

(30) Foreign Application Priority Data

Mar. 20, 2003 (JP) ..... 2003-079186
Jun. 25, 2003 (JP) ..... 2003-181233
Jan. 20, 2004 (JP) ..... 2004-011937

(51) Int. Cl.
*G03G 9/135* (2006.01)

(52) U.S. Cl. ..... 430/115

(58) Field of Classification Search ..... 430/115, 430/114

See application file for complete search history.

(56) References Cited

U.S. PATENT DOCUMENTS 3,639,122 A 2/1972 Shimizu et al.
3,772,281 A 11/1973 Tubuko et al.
4,060,493 A 11/1977 Tsubuko et al.
4,081,391 A 3/1978 Tsubuko et al.
4,087,393 A 5/1978 Tsubuko et al.
4,264,699 A 4/1981 Tsubuko et al.
4,360,580 A 11/1982 Tsubuko et al.
4,415,533 A 11/1983 Kurotori et al.
4,640,605 A 2/1987 Ariyama et al.
4,669,859 A 6/1987 Mochizuki et al.
4,720,731 A 1/1988 Suzuki et al.
4,748,934 A 6/1988 Mochizuki et al.
4,800,839 A 1/1989 Ariyama et al.
4,801,965 A 1/1989 Mochizuki et al.
4,833,500 A 5/1989 Mochizuki et al.
4,860,050 A 8/1989 Kurotori et al.
4,925,766 A * 5/1990 Elmasry et al. ..... 430/115
4,948,691 A 8/1990 Kurotori et al.
4,985,733 A 1/1991 Kurotori et al.
4,987,457 A 1/1991 Mochizuki et al.
5,021,834 A 6/1991 Tsuruoka et al.
5,099,289 A 3/1992 Kurotori et al.
5,155,531 A 10/1992 Kurotori et al.
5,155,534 A 10/1992 Kurotori et al.
5,164,778 A 11/1992 Tanabe et al.
5,208,211 A 5/1993 Kurotori et al.
RE34,437 E 11/1993 Ariyama et al.
5,263,698 A 11/1993 Higuchi et al.
5,359,398 A 10/1994 Echigo et al.
5,384,225 A 1/1995 Kurotori et al.
5,402,220 A 3/1995 Tanaka et al.
5,411,833 A * 5/1995 Swidler ..... 430/108.3
5,463,447 A 10/1995 Kurotori et al.
5,463,453 A 10/1995 Kurotori et al.
5,642,188 A 6/1997 Mochizuki et al.
5,678,158 A 10/1997 Kurotori et al.
5,708,938 A 1/1998 Takeuchi et al.
5,809,388 A 9/1998 Inada et al.
5,937,247 A 8/1999 Takeuchi et al.
5,987,281 A 11/1999 Kurotor et al.
6,038,421 A 3/2000 Yoshino et al.
6,108,508 A 8/2000 Takeuchi et al.
6,150,066 A 11/2000 Kurotori et al.
6,154,624 A 11/2000 Sasaki et al.
6,405,008 B1 6/2002 Obu et al.
6,466,757 B1 10/2002 Itaya et al.
6,501,932 B1 12/2002 Obu et al.
6,515,747 B1 2/2003 Satoh et al.
6,539,191 B1 3/2003 Itaya
6,627,696 B1 * 9/2003 Takao et al. ..... 524/588
6,640,073 B1 10/2003 Kurotori et al.
6,694,112 B1 2/2004 Sasaki et al.
6,735,408 B1 5/2004 Yoshino et al.
6,738,592 B1 5/2004 Sasaki et al.

* cited by examiner

*Primary Examiner*—John L Goodrow
(74) *Attorney, Agent, or Firm*—Oblon, Spivak, McClelland, Maier & Neustadt, P.C.

(57) ABSTRACT

A liquid developer capable of preventing each of the disadvantages of uneven development density caused by uneven distribution of colored particles, poor transfer due to an insufficient amount of the liquid, and poor fixing due to an excess amount of the liquid, without complicating handling with the generation of volatile gas. Present on the surface of toner particles to be dispersed in a carrier liquid made of dimethyl silicone are a silicone group of one-end methacryloxy-modified silicone and a basic group. The silicone group prevents agglutination of the toner particles with each other. The silicone group functions as an affinity group and provides the toner particles with an affinity to the carrier liquid. Thus, it becomes possible to disperse the toner particles uniformly in the carrier liquid. Besides, the basic group on the surface of toner particles allows the toner particles to ensure the desired charge amount. Therefore, colored particles such as the toner particles hardly agglutinate with each other in a nonpolar insulating liquid to be provided as a nonaqueous solvent, while the colored particles can be electrophoresed at high speed by an electric field.

23 Claims, 11 Drawing Sheets

FIG. 5

| DEVELOPER TYPE | SPECFIC EXAMPLE NO. | KF96-50 | TONER SOLID CONTENT | DISPERSION-FACILITATING SUBSTANCE | MOBILITY | FIXING ABILITY |
|---|---|---|---|---|---|---|
| COMPARATIVE EX. | | 5 | 2 | 3 | × | ○ |
| A | 3 & 4 | 5 | 2 | 0 | △ | ○ |
| B | 3 & 4 | 5 | 2 | 0.1 | ○ | ○ |
| C | 3 & 4 | 5 | 2 | 0.2 | ○ | ○ |
| D | 3 & 4 | 5 | 2 | 0.6 | ○ | ○ |
| E | 3 & 4 | 5 | 2 | 1 | ○ | ○ |
| F | 3 & 4 | 5 | 2 | 3 | ○ | △ |
| G | 3 & 4 | 5 | 2 | 20 | ○ | × |

LIQUID DEVELOPER FOR IMAGE FORMING APPARATUS

BACKGROUND OF THE INVENTION

1. Field of the Invention

The present invention relates to a liquid developer containing colored particles such as toner in the liquid and develops a latent image formed on an image carrier such as a photoconductive member by the colored particles, and also relates to a copier, facsimile apparatus, printer or similar image forming apparatus using the liquid developer.

2. Description of the Background Art

A liquid developer having toner dispersed in an organic solvent mainly composed of an isoparaffinic hydrocarbon has been conventionally known in the art, and is, for example, disclosed in JP 05-045937 A. Examples of such organic solvents which are commercially available in the market include Isopar (trade name) from Exxon Corp., Shellsol (trade name) from Shell Kagaku KK., and Soltol (trade name) from Philips Petroleum Co., Ltd.

Besides, liquid developers in which colored particles are dispersed in nonvolatile liquids have been also known in the art. For example, a nonvolatile liquid using silicone oil is disclosed in JP 12-206738 A. Furthermore, an example of a liquid-type image forming apparatus using a liquid developer is disclosed in JP 2001-305887 A.

As disclosed in JP 05-045937 A, however, the conventional liquid developer using an organic solvent mainly composed of a high-volatility isoparaffinic hydrocarbon as a liquid has a problem, that is, it is very hard to handle the isoparaffinic hydrocarbon because of its high volatility.

On the other hand, since the liquid developer disclosed in JP 12-206738 A uses a nonvolatile liquid and does not generate toxic volatile gas, the problem mentioned above can be solved. However, this kind of liquid developer tends to cause deterioration in image quality when the proportion of the liquid to colored particles is hardly adjusted in an appropriate manner in the successive steps of the image forming process including developing, transferring, and fixing steps. In the developing step, for instance, colored particles are electrophoresed from a developer carrier to a photoconductive member. If the proportion of the liquid is too small, such an electrophoresis of the colored particles can not be effectively performed. Likewise, the transferring step requires an amount of the liquid enough to electrophorese the colored particles constituting a visible image from the image carrier to a recording medium such as a sheet of transfer paper. Nevertheless, the transferring step makes the colored particles more difficult to be electrophoresed. This is because the colored particles electrophoresed are allowed to be applied to the latent image in the preceding developing step while a significant portion of the liquid remains on the developer carrier and is then isolated from a visible image after the development. Therefore, the amount of the liquid throughout the process from the developing step to the transferring step should be controlled to prevent removal of an excessive amount of liquid from the visible image.

However, at the time of fixing the visible image transferred to the recording medium with heat and pressure, absorbing an excessive amount of the liquid in the recording medium prevents the visible image from fixing on the recording image so as to lower the fixing ability. Since the liquid is nonvolatile, deterioration in fixing ability becomes unavoidable when the transfer of the visible image involves the absorption of the liquid in the recording medium. In the transferring step, while ensuring the amount of the liquid enough to allow the electrophoresis of the visible image, the liquid amount should be kept within a level at which the subsequent fixing process is effectively performed.

To solve this problem, JP 2001-305887 A proposes a liquid-type image forming apparatus in which an excessive amount of liquid is removed from a visible image prior to transfer of the visible image to a recording medium. The liquid-type image forming apparatus insures a favorable transfer characteristic by removing an excessive part of the liquid beyond an amount of liquid required for the transfer from a visible image having a large amount of liquid which affects the fixing process.

However, the inventors of the present invention have diligently studied and found that the fixation of a visible image may be affected even though the prior art liquid-type image forming apparatus is used. Specifically, when the colored particles are unevenly dispersed in the liquid developer, unevenness in development density inevitably occurs because high and low toner density portions are generated in the liquid developer. Thus, the inventors prepared a liquid developer in which toner provided as colored particles and a dispersant for facilitating the dispersion of the toner were dispersed in silicone oil provided as a nonvolatile liquid. The dispersant used is adsorbed to the surface of toner particles and the conformation thereof prevents the contact between the toner particles to allow the respective toner particles to be favorably dispersed in the liquid. When the prepared liquid developer was applied to the liquid-type image forming apparatus mentioned above to form an image, the toner particles were dispersed enough to effectively suppress unevenness in development density but the fixing ability is lowered. This is because, at the time of removing an excessive part of the liquid from a visible image prior to the transfer, the dispersant unavoidably remains in the visible image. The dispersant itself or the liquid absorbed therein deteriorated the fixing ability of the toner.

SUMMARY OF THE INVENTION

It is an object of the present invention is to provide a liquid developer capable of preventing any of disadvantages including unevenness in development density due to uneven dispersion of colored particles, poor transfer due to an insufficient amount of a liquid, and poor fixation due to an excessive amount of the liquid, without being affected by the generation of volatile gas.

Another object of the present invention is to provide an image forming apparatus using the liquid developer.

In accordance with the present invention, there is provided a liquid developer for developing a latent image on a latent image carrier. The liquid developer comprises colored particles made of a resin and a colored substance and a liquid provided as a dispersion medium of the colored particles. The liquid contains a dispersion-facilitating substance for facilitating dispersion of the colored particles in the liquid. The dispersion-facilitating substance is charged with polarity opposite to polarity of the colored particles and incorporated in the liquid at a ratio of 0.05 to 20 parts by weight per part by weight of the colored particles.

BRIEF DESCRIPTION OF THE DRAWINGS

The above and other objects, features and advantages of the present invention will become more apparent from the following detailed description taken with the accompanying drawings in which:

FIG. 5 is a table showing experimental results with respect to the mobility and fixing ability of the toner in Specific Examples 3 and 4 of the present invention;

DESCRIPTION OF THE PREFERRED EMBODIMENT

Figure 1:
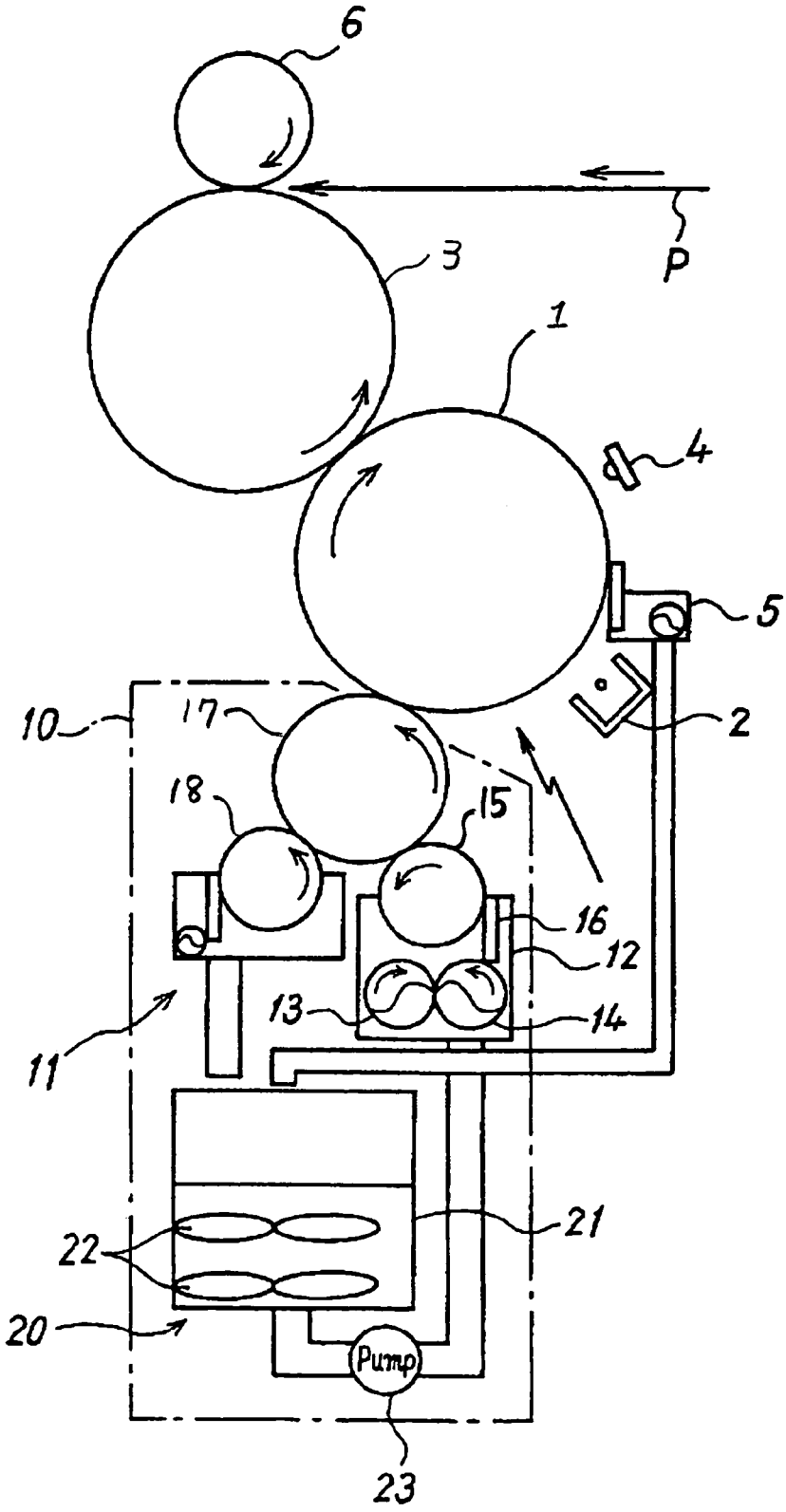
FIG. 1 is a diagram showing a construction of a principle part of a printer as a liquid-type image forming apparatus in accordance with the present invention.

First, the present invention has been completed on the basis of the study as described below conducted by the inventors of the present invention with their exceptional efforts. Briefly, the inventors prepared prototyped a liquid developer using a dispersant being charged opposite to toner, and then an image was actually outputted therefrom. Surprisingly, as a result, an excellent fixing ability was attained in spite of mixing with the dispersant. In this case, however, a local omission of an image occurs on the resulting image because of insufficient transfer. In other words, a toner image was partially left on an intermediate transfer member at the time of transfer. This is because the amount of the liquid was insufficient at the time of transfer so that the toner could not be electrophoresed in a preferable manner from the intermediate transfer member to a recording medium such as a sheet of transfer paper. Thus, the dispersant was hardly found on both the recording medium and the intermediate transfer member after the transferring step. Similarly to the liquid, almost to dispersant was found at the transferring step. This is because, at the developing step, the toner in the liquid developer was electrophoresed from the side of a developer carrier such as a developing roller to the side of a latent image carrier such as a photoconductive member while the dispersant charged opposite to the toner was concentrated to the side of the developer carrier by electrophoresing the dispersant in the reverse direction.

Next, the inventors of the present invention have conducted similar experiments to one described above, except for an increase in proportion of the dispersant in the liquid developer. As a result, a good quality image without poor fixation and transfer was able to be formed. The liquid or the dispersant could be hardly found in the recording medium after the transferring step. On the other hand, on the intermediate transfer member, the presence of the dispersant was able to be confirmed in addition to an appropriate amount of the liquid. In view of the above, it is conceivable that the toner in a visible image was able to be electrophoresed in a favorable manner because an appropriate amount of the liquid was retained in a gap formed between the dispersant being remained up to the transferring step and the toner particles. In addition, it is conceivable that the recording medium was able to be prevented from absorbing an excessive amount of the liquid because the dispersant being remained up to the transferring step was electrophoresed taking along with the surrounding liquid toward the intermediate transfer member in the direction opposite to the toner.

As described above, the inventors of the present invention have found that the amount of the liquid in each of the steps can be favorably controlled by using a dispersant being charged opposite to the toner and by appropriately adjusting the dispersant concentration in the liquid. As a result of their study with their exceptional efforts, they have revealed that a good image can be formed by mixing the dispersant at a concentration in the range of 0.05 to 20 parts by weight per part by weight of toner. When the mixing ratio of the dispersant was less than 0.05 parts by weight, the toner could not be electrophoresed in a favorable manner at the transferring step and the local omission occurs on resulting image. In addition, when the mixing ratio of the dispersant was more than 20 parts by weight, large amounts of the dispersant and liquid were absorbed in a recording medium, resulting in poor fixation.

Hereinafter, a liquid developer of an embodiment of the present invention will be described.

The liquid developer is prepared by dispersing at least toner particles and a dispersion-facilitating substance into a nonvolatile liquid, the dispersing toner particles being provided as colored particles and made of a resin and a colored substance, and the dispersion-facilitating substance being provided for facilitating the dispersion of the toner particles in the liquid. The dispersion-facilitating substance and the toner were dispersed in proportions of 0.05 to 10 parts by weight of the dispersion-facilitating substance to 1 part by weight of the toner.

The inventors of the present invention prepared liquid developers by using silicone oil as a nonvolatile liquid and by adjusting the proportions of the toner and the dispersion-facilitating substance as follows:

(1) Developer A : dispersion medium 9, toner solid content 1, dispersion-facilitating substance 0;

(2) Developer B : dispersion medium 9, toner solid content 1, dispersion-facilitating substance 0.05;

(3) Developer C : dispersion medium 9, toner solid content 1, dispersion-facilitating substance 0.1;

(4) Developer D : dispersion medium 9, toner solid content 1, dispersion-facilitating substance 0.3;

(5) Developer E : dispersion medium 9, toner solid content 1, dispersion-facilitating substance 1;

(6) Developer F : dispersion medium 9, toner solid content 1, dispersion-facilitating substance 10; and (7) Developer G : dispersion medium 9, toner solid content 1, dispersion-facilitating substance 20.

Subsequently, images were actually outputted using those liquid developers. The output of the image was performed using a printer shown in FIG. 1. As shown, the printer is a liquid-type image forming apparatus and includes a charging device 2, a developing device 10, an intermediate transfer drum 3, a discharger 4, and a cleaning device 5, which are mounted around a photoconductive drum 1 provided as a latent image carrier. Furthermore, the printer also includes a transfer roller 6 which rotates in contact with the intermediate transfer drum 3 and an exposing device arranged on an area not shown in FIG. 1.

The photoconductive drum has a surface made of amorphous silicon (a-Si) and is driven to rotate at constant speed in clockwise direction in FIG. 1 by driving means (not shown) at the time of printing. Subsequently, the photoconductive drum 1 is uniformly charged, for example, at 600 V in dark by corona discharge from the charging device 2. The exposing device has a scanning optical system which scans the uniformly charged surface of the photoconductive drum 1 by exposing the surface to LED or laser beams corresponding to image information. The exposed portion of the photoconductive drum 1 shows attenuation of potential, for example, resulting in an electrostatic latent image having a potential of 50 V or less. The electrostatic latent image will be developed into a toner image as a visible image by the developing device 10 using a liquid developer.

It is to be noted that an organic photoconductor (OPC) may be used as the photoconductive drum 1 and that in place of the charging device 2 with corona discharge, a charging device of the type which applies a predetermined charging bias to a charging member such as a charging roller in contact with the photoconductive drum 1 may be used. Furthermore, an electrostatic latent image may not be formed by exposure but may be formed by a combination of a dielectric material as a latent image carrier and an ion-flow device as a latent image forming means.

The intermediate transfer drum 3 is brought into contact with the photoconductive drum 1 to form a nip portion for primary transfer, while the intermediate transfer drum 3 is driven to rotate in the counterclockwise direction in FIG. 1 such that the surface of the drum 3 moves in the forward direction with the photoconductive drum 1 through the nip portion. At the nip portion for primary transfer, a primary transfer electric field is formed by a potential difference between the electrostatic latent image on the photoconductive drum 1 and the intermediate transfer drum 3. The toner image which entered a nip portion for primary is electrostatically transferred as primary transfer on the intermediate transfer drum 3 by the primary transfer electric field and the nip pressure. It is to noted that, in place of the intermediate transfer drum 3, an endless intermediate transfer belt driven by a plurality of rollers may be used.

The above transfer roller 6 is brought into contact with the intermediate transfer drum 3 to form a nip portion for secondary transfer, while rotating in the clockwise direction in FIG. 1 such that the surface of the transfer roller 6 moves in the forward direction with the intermediate transfer drum 3 through the nip portion. In addition, a secondary transfer bias is applied by an electric power supply (not shown) to the transfer roller 6 so that a secondary transfer electric field is formed on the nip portion for secondary transfer. On the other hand, a sheet feeding device (not shown) feeds a sheet of transfer paper P as a recording medium toward the nip portion for secondary transfer in sync with the movement of a toner image on the intermediate transfer drum 3. The toner image on the intermediate transfer drum 3 is brought into intimate contact with the transfer paper P at the nip portion for secondary transfer and is then transferred as secondary transfer to the transfer paper P due to the secondary transfer electric field and the nip pressure. Subsequently, the toner image on the transfer paper P is transported to a fixing device (not shown) and is then fixed on the transfer paper P with heat and pressure.

A residual charge on the surface of the photoconductive drum 1 which has passed through the nip portion for primary transfer is discharged by the discharger 4 and the liquid developer remaining on the surface of the photoconductive drum 1 is removed by the cleaning device 5. The cleaning initializes the surface of the photoconductive drum 1 for subsequent image formation.

The developing device 10 has a developing section 11 and a recovery section 20. The developing section 11 stores a liquid developer in a tank 12. The liquid developer is not a low viscosity and low concentration liquid developer which has been widely used in the art but a high viscosity and high concentration liquid developer. The low viscosity and low concentration liquid developer has a viscosity of about 1 cSt, which contains toner at a concentration of about 1 wt % in an insulating liquid carrier generally referred to as Isopar (registered trademark) or the like widely available in the market. In contrast, the high viscosity and high concentration liquid developer contains a high concentration of toner in a nonvolatile liquid carrier such as silicone oil, normal paraffin, vegetable oil, or mineral oil. Specifically, the high viscosity and high concentration liquid developer contains toner at a concentration of about 5 to 40 wt % and has a viscosity of about 10 to 500 mPa·S.

In the tank 12, there are two agitating screws 13, 14 which are arranged in parallel with each other and dipped in the liquid developer. As indicated by the arrows in FIG. 1, the agitating screws 13, 14 are rotated in directions opposite to each other by a driving device (not shown). When the developing device 10 starts developing, the agitating screws 13, 14 rotate in the directions opposite to each other to agitate the liquid developer in the tank 12. The agitation causes the liquid level of the liquid developer to raise between the agitation screws 13, 14 so that the liquid developer is adhered to an anirox roller 15 arranged above the screws 13, 14.

Thus, the anirox roller 15 in the developing section 11 draws the liquid developer from the tank 12 while being brought into a rotary movement by the driving device. A spiral groove pattern (not shown) is carved on the peripheral surface of the anirox roller 15 with a fineness of about 100 to 200 lpi. A plurality of minute hollows are formed in the groove pattern such that the minute hollows are aligned in the line direction. The minute hollows accommodate part of the liquid developer drawn by the anirox roller 15.

A doctor blade 16 made of a metal material such as stainless steel comes in contact with the surface of the anirox roller 15 to regulate the amount of the liquid developer drawn by the anirox roller 15. The regulation allows the amount of the liquid developer carried on the anirox roller 15 to be correctly measured to an amount of corresponding to the volume of the minute hollows.

In the developing device 10, a developing roller 17 is arranged as a developer carrier on the upper side of the anirox roller 15 in FIG. 1 such that the developing roller 17 is allowed to rotate while contacting the surface of the anirox roller 15. The liquid developer on the surface of the anirox roller 15 is applied with a uniform thickness at the contact portion. The developing roller 17 has a conductive elastic layer made of conductive urethane rubber or the like on its peripheral surface. The developing roller 17 rotates at the same velocity as that of the photoconductive drum 1 while contacting the surface the photoconductive drum 1 to form a nip portion for development. Furthermore, a developing bias is applied to the developing roller 17 through a developing bias supplu means (not shown). The developing bias is adjusted to a level (e.g., 500 V) which is positive just as in the case of the electrostatic property of the toner and smaller than a uniformly charged potential on the photoconductive drum 1.

At the developing nip portion, each of the developing roller 17, an unexposed portion of the photoconductive drum 1, and the electrostatic latent image has the same potential polarity as that of the toner. In addition, the potential level becomes smaller in order by the unexposed portion, the developing roller 17, and the latent image (600 V, 500 V, and 50 V). Therefore, a non-developing potential that electrostatically moves the toner toward the developing roller 17 with a smaller potential acts between the unexposed portion and the developing roller 17 (from 600 V to 500 V). In addition, a developing potential that moves the toner toward the latent image having a smaller potential acts between the developing roller 17 and the latent image (from 500 V to 50 V).

Therefore, at the developing nip portion, the toner in a thin layer of the developer is concentrated toward the surface of the developing roller 17 between the developing roller 17 and the unexposed portion by electrophoresis. On the other hand, the toner adheres to the latent image between the developing roller 17 and the latent image by electrophoresis. This adhesion allows the latent image to be developed to a toner image.

The liquid developer adhered to the developing roller 17 after passing through the developing nip portion is recovered by a recovering roller 18 rotating in contact with the developing roller 17. Then, a feeding screw 19 feeds the liquid developer to the recovery section 20.

The recovery section 20 includes a recovery tank 21, agitating propellers 22, and a recovery pump 23. In addition, a concentration-adjusting device (not shown) is also included in the section 20. The recovered developer fed from the feeding screw 19 is stored in the recovery tank 21. The liquid developer on the photoconductive drum 1 is removed by the cleaning device 5 and stored in the recovery tank 21. The agitating propellers 22 agitate the mixture of those developers and the concentration-adjusting device supplies the additional toner and liquid to adjust the concentration of toner to an initial level. Subsequently, the recovery pump 23 moves the resulting developer back to the tank 12 in the developing section 11, so that the developer can be reused for development.

The inventoros of the present invention conducted an experiment in which seven different types of the above liquid developers were individually applied to the printer constructed as described above and images were outputted under the following conditions:

the concentration of toner in the liquid developer is 20%;

an average amount of electric charge on toner in the liquid developer is 100 μC/g;

process linear velocity, which is the peripheral velocity of the photoconductive drum 1 or the like, is 300 mm/sec;

the length of the developing nip portion along the peripheral surface of the roller is 3 mm;

a developing time is 10 msec;

the thickness of the thin layer of the developer at the developing nip portion is 10 μm;

the length of the primary transfer nip portion along the peripheral surface of the drum is 9 mm;

the strength of the primary transfer electric field (between the latent image and the intermediate transfer drum) is −300 V;

a primary transferring time is 30 msec;

the length of the secondary transfer nip portion along the peripheral surface of the drum is 6 mm;

a secondary transferring time is 20 msec; and a heating temperature of the fixing device is 120° C.

Figure 2:
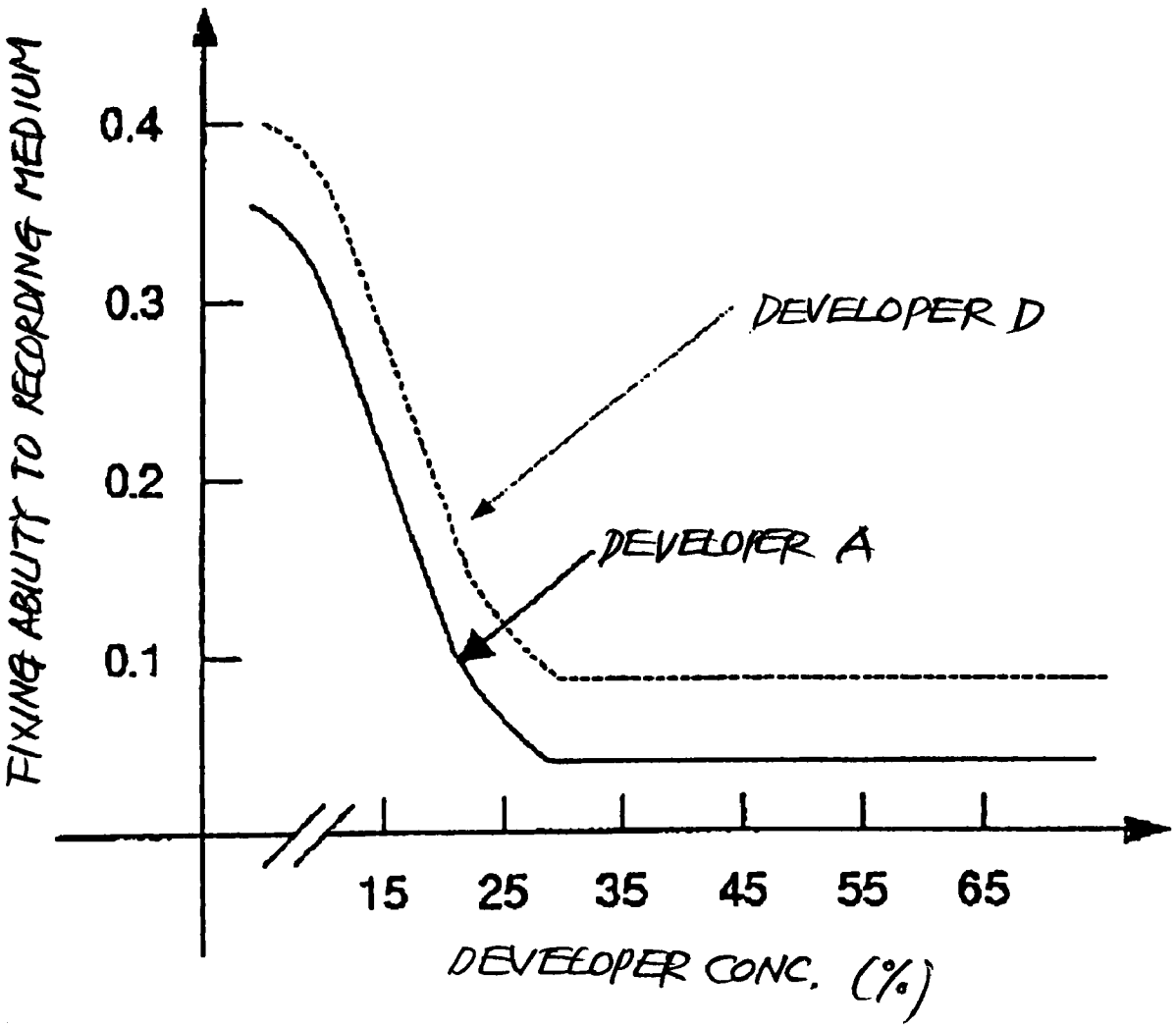
FIG. 2 is a graphical representation of a proportion of a dispersion-facilitating substance to the toner and the transferability of a toner image.

FIG. 2 shows the results of the experiment, that is, "the proportion of the dispersion-facilitating substance to the toner" and the transferability of the toner image to the recording medium. The toner image was evaluated for transferability as follows. The primary transfer rate represents a result obtained by the calculation of fraction in which the denominator is the image density on the intermediate transfer member after the primary transfer and the numerator is the difference between the image density before the primary transfer and the image density after the primary transfer. Likewise, the secondary transfer rate can be also obtained. Moreover, when the intermediate transfer member is not used, a result can be obtained by the calculation of fraction in which the denominator is the image density on the photoconductive member and the numerator is the difference between the image density before the transfer and the image density after the transfer. As shown, the developer A exerts a transfer rate of about 90% (to transfer sheet) when the toner has a concentration of 30% or less to form a good image with few image defects. Then, the transfer rate decreases as the toner concentration rises. A transfer rate of 50% or more is within an allowable range. When the toner concentration reaches 70%, the transfer rate will be less than the allowable range to cause poor secondary transfer. At this time, the transfer rate of the developer D was excellent. Therefore, it is found that, even the toner concentration is high, the transferability can be secured when the dispersion distance of toner fine particles is physically taken with the dispersant. It is conceivable that the dispersion-facilitating substance should be at least 0.05 parts by weight per part by weight of the toner.

Therefore, in the liquid developer of this embodiment, the dispersion-facilitating substance is mixed with the toner at a ratio of 0.05–20 parts by weight of the former to 1 part by weight of the latter.

Figures 3A, 3B:
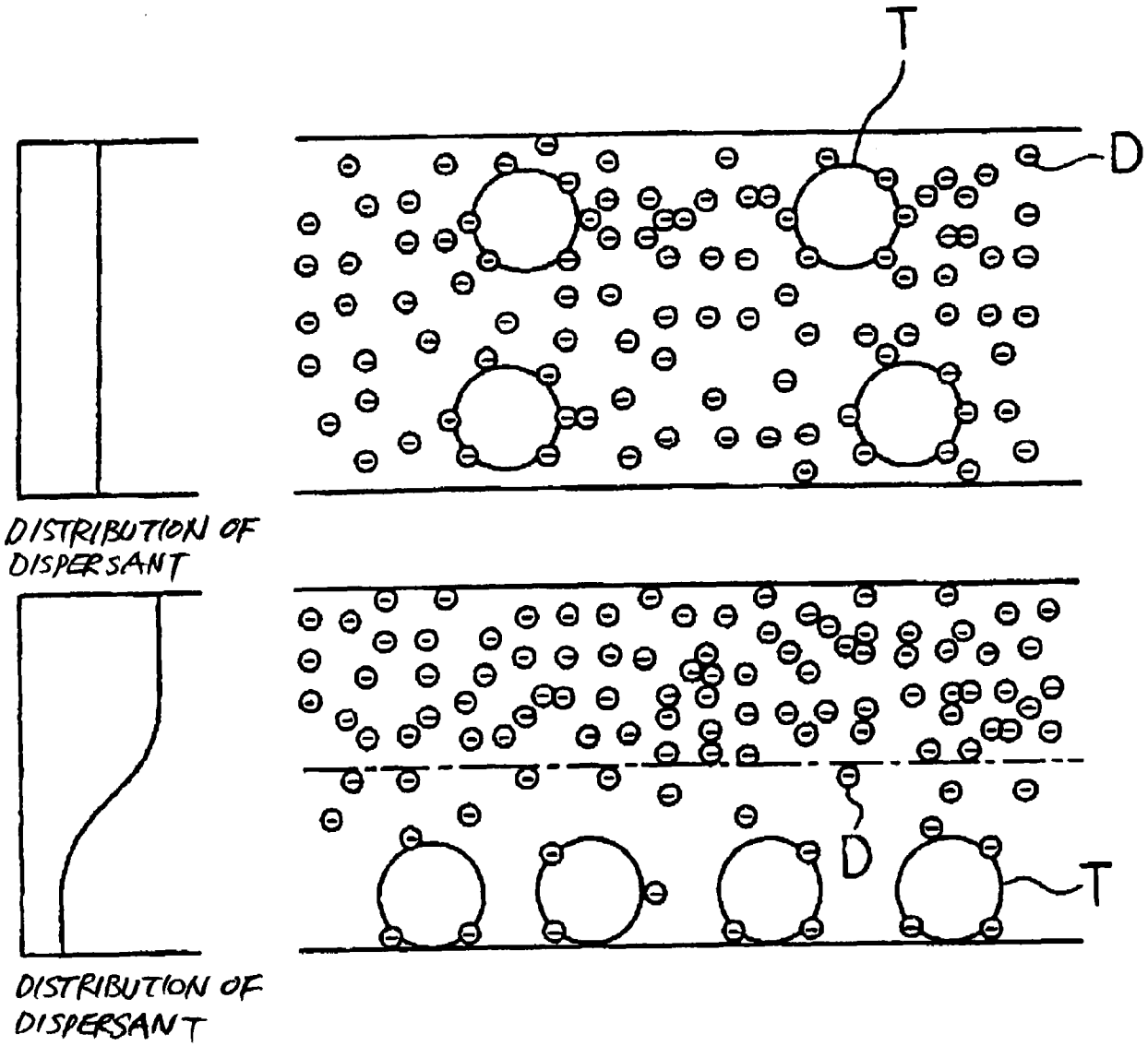
FIGS. 3A and 3B are schematic diagrams showing dispersion states of the toner particles and the dispersion-facilitating substance in the liquid developer.

FIGS. 3A and 3B schematically illustrate the dispersion states of the toner particles and dispersion-facilitating substance in the liquid developer of this embodiment. In a liquid developer before the developing and transferring steps (i.e., a liquid developer where no electric field for the development or transfer is applied), a plurality of negatively charged dispersion-facilitating substances D are adsorbed on the surface of each toner particle T being positively charged as shown in FIG. 3A. The unadsorbed dispersion-facilitating substances D are uniformly dispersed in insulative silicone oil. As the dispersion-facilitating substances D adsorbed on the respective particles and the dispersion-facilitating substances D dispersed in the silicone oil are sterically located between the toner particles, so that the toner particles can be uniformly dispersed in the silicone oil by receiving a so-called steric repulsive force.

On the other hand, in a liquid developer placed in an electric field in the developing or transferring step, the toner particles T are electrophoresed toward the latent image or the target place of the transfer (below in the example shown in FIGS. 3A & 3B), while the dispersion substances D are electrophoresed toward the developing roller or the starting position of the transfer. Therefore, the distribution of the toner particles T is leaned on the side of the latent image or on the target place of the transfer, and also the distribution of the dispersion-facilitating substance is leaned on the side of the developing roller or on the side of the starting position of the transfer. However, not all the toner particles T and dispersion-facilitating substances D are electrophoresed in the respective directions. This is because some of them are electrophoresed in the direction opposite to each other and conflict with each other so that they are hardly electrophoresed and remains.

Therefore, in the latent image or the liquid on the target place of the transfer, a very small amount of the dispersion-facilitating substance D remains in a large amount of the toner particles T. When the dispersion-facilitating substance D remains as described above, a gap which can retain the silicone oil is formed between the toner particles. Therefore, in a next transferring step, the toner particles T are favorably electrophoresed in the silicone oil retained in the gap.

In the liquid developer of this embodiment, it is desirable to use a dispersion-facilitating substance which is charged opposite to the toner by means of a polar group. This is because the charge of the polar group is retained on the surface of the dispersion-facilitating substance and thus the dispersion-facilitating substance is favorably adsorbed to the surface of the toner particles with the charge to allow the toner particles to be dispersed with more reliability.

Examples of the polar group include an acidic group, a basic group, and a hydroxyl group. Of those, the acidic group and hydroxyl group, which may disperse the toner minutely or promote a crosslinking reaction, are preferable. Just as this embodiment, when the positively charged toner is used, a substance having an acidic group which is negatively charged such as a carboxyl group, a sulfonic group, or a phosphonic acid group may be used as the dispersion-facilitating substance. Furthermore, the carboxyl group having a weak acidic strength is preferably used in consideration of difficulty in condensing the toner particles, the rate of the crosslinking reaction, and the like.

Furthermore, examples of the basic group include, but not specifically limited to, primary to quaternary amino groups. In addition, an amphoteric group having both an acidic group and a basic group may be used.

Moreover, in the liquid developer to which this embodiment is applied, the liquid in which the toner particles are dispersed has a thermal property represented by its high flash point and an electrical insulating property. The toner particles containing pigment components are dispersed in this insulating liquid. In addition, a resin as a dispersion-facilitating substance, an insulating liquid, toner particles, and a charge control agent may be uniformly dispersed by the addition of appropriate amounts thereof.

Here, in the case of the toner particles using a conductive material having a low electric resistance value such as carbon black as a pigment component, the conductive material exists on the periphery of the toner particles. Thus, when the toner particles are condensed, it becomes difficult to control the behavior of the toner particles owing to an electric field generated by a current passing between the toner particles. The difficulty in control of the behavior of the toner particles due to the condensation increases as the toner concentration increases. Furthermore, when the insulating liquid used is volatile, the carrier liquid volatilizes in the process. Therefore, in the developing area, transferring area, or the like, in which the behavior of toner particles is controlled by an electric field, the toner increases in concentration. Therefore, in this case, it becomes more difficult to control the behavior of the toner particles by a developing electric field or a transfer electric field.

In addition, when the insulating liquid used is nonvolatile, after toner particles are moved by an electric field, the toner concentration at the target place of the movement increases, so that it becomes difficult to control the behavior of the toner particles. Besides, to meet the demand of an improvement in speed of image formation, it is necessary to reduce the amount of the carrier liquid as far as possible. Thus, the toner increases in concentration as a consequence even though the carrier liquid is nonvolatile, so that it becomes difficult to control the behavior of toner particles.

Besides, the proportion of the carrier liquid to the toner particles increases as the toner increases in concentration. Thus, the insulating liquid acting as an insulating film on the outer periphery of toner particles becomes difficult to be sufficiently located between the toner particles. As a result, it becomes difficult to maintain the insulating properties of toner particles, and thus the polarity of toner particles will be reversed as a consequence of injecting the charge of reverse polarity into the toner particles when the toner particles receive the bias of reverse polarity at the primary or secondary transfer. The polarity reversal of the toner particles is also one of the causes that make it more difficult to control the behavior of toner particles by the transfer electric field.

As described above, it becomes difficult to secure the insulating properties of toner particles as the toner increases in concentration in the process of image formation. Thus, it is important to inhibit the condensation of toner particles to allow the insulating liquid to be located between the toner particles.

It is desirable to use a dispersion-facilitating substance that allows self dispersion (it means that the substance itself disperses in a liquid by its chemical properties) having an acid number of 5 to 200 KOHmg/g. When the substance has an acid number of less than 5 KOHmg/g, it becomes difficult to adsorb the substance on the toner in a favorable manner and also favorable electrophoresis cannot be done because the charge of the substance is small. In addition, when the substance has an acid number of more than 200 KOHmg/g, the self dispersion becomes difficult because of its high acid strength.

It is desirable to use a dispersion-facilitating substance having an average molecular weight of 1,000 or more because the toner can be finely dispersed in the liquid.

Examples of materials for preparing the dispersion-facilitating substance capable of self dispersion include, but not specifically limited to, acrylic, polyester, polyurethane, epoxy, and amino polymer compounds. Each of them may be independently used or in combination with one or more other compounds of them. Of those, methyl methacrylate (acryl) or an acrylic polymer compound predominantly composed thereof are desirably used. This is because the acrylic monomer or polymer does not become massive even if it polymerizes, so that it can be dispersed in a minute state and a polar group (a carboxyl group or hydroxyl group) can be also introduced comparatively simply.

Furthermore, it is desirable to use a graft copolymer as an acrylic polymer compound because of the following reasons. That is, the graft copolymer has a structure chemically divided into two portions, a toner-adsorbing portion and a portion having an affinity to a nonvolatile liquid such as silicone oil, so that it will favorably adsorb to the toner while favorably floating in the liquid to exert absolute dispersibility.

A graft portion of the graft polymer is preferably one having a molecular weight of 500 to 10,000 because a good affinity to the nonvolatile liquid and good dispersibility can be exerted. The varieties of the graft portion include polyether, polyester, styryl, (meth)acrylate, and silicone. Of those, silicone is preferable. This is because, when silicone oil is used as a nonvolatile liquid, it becomes possible to make a well affinity between the silicone of the graft portion and the silicone oil to afford the dispersibility in a favorable manner.

A process for manufacturing an acrylic polymer compound is not specifically limited. However, examples thereof include those in which a monomer having a polar group and another monomer which can polymerize with the monomer are reacted in a non-reactive solvent in the presence or absence of a catalyst. Of those, a process in which a monomer having a polar group and a silicone macro-monomer are polymerized as essential components is preferable. Furthermore, a process in which an acrylic polymer having a reactive group is synthesized and is then reacted with reactive silicone to graft the polymer is also preferable.

Among polar group-containing acrylic monomers, examples of a monomer having an acidic group as a polar group include: monomers each having a carboxyl group such as acrylic acid, methacrylic acid, crotonic acid, ethacrylic acid, propylacrylic acid, isopropylacrylic acid, itaconic acid, fumaric acid, acroyloxyethylphthalate, and acroyloxysuccinate; monomers each having a phosphonic acid group such as monomers each having a sulfonic group including 2-sulfonate ethyl acrylate, 2-sulfonate ethyl methacrylate, and butylacrylamide sulfonic acid, 2-phosphonate ethyl methacrylate, and 2-phosphonate ethyl acrylate; and monomers each having a hydroxyl group such as 2-hydroxyethyl acrylate, 2-hydroxyethyl methacrylate, hydroxypropyl acrylate, and hydroxypropyl methacrylate. Of those, a monomer having a carboxyl or hydroxyl group is preferable.

On the other hand, examples of an acrylic monomer having a basic group include: monomers each having a primary amino group such as acrylamide, aminoethyl acrylate, aminopropyl acrylate, methacrylamide, aminoethyl methacrylate, and aminopropyl methacrylate; monomers each having a secondary amino group such as methylaminoethyl acrylate, methylaminopropyl acrylate, ethylaminoethyl acrylate, ethylaminopropyl acrylate, methylaminoethyl methacrylate, methylaminopropyl methacrylate, ethylaminoethyl methacrylate, and ethylaminopropyl methacrylate; monomers each having a tertiary amino group such as dimethylaminoethyl acrylate, diethylaminoethyl acrylate, dimethylaminopropyl acrylate, diethylaminopropyl acrylate, dimethylaminoethyl methacrylate, diethylaminoethyl methacrylate, dimethylaminopropyl methacrylate, and diethylaminopropyl methacrylate; and monomers each having a quaternary amino group such as dimethylaminoethyl acrylate methylchloride salt, dimethylaminoethyl methacrylate methylchloride salt, dimethylaminoethyl acrylate benzylchloride salt, and dimethylaminoethyl methacrylate benzylchloride salt.

Examples of a macro-monomer to introduce a graft portion include: a polyether macro-monomer prepared by an addition reaction of a hydroxyalkylene monomethacrylate with an alkylene oxide by using a cationic catalyst; an ester macro-monomer prepared by polyesterification of a polybasic acid and a polyalcohol and then esterification with glycidyl methacrylate; a styryl macro-monomer prepared by anionic polymerization of styrene and a treatment of the living terminal with an appropriate terminator; a silicone macro-monomer prepared by methoxylation of water glass provided as a starting material and then introduction of methacrylate to the terminal; and macro-monomers obtained by other methods.

Among the monomers described above, a silicone macro-monomer is most preferable from the viewpoint of an affinity to a nonpolar liquid. Examples of the macro-monomer include a macro-monomer prepared by binding dimethylsiloxane to a known general methacroyl group directly or via an alkyl group, such as FM 0721 (manufactured by Chisso Corporation), AK-5, AK-30, and AK-32 (manufactured by Toagosei Co., Ltd.).

Examples of other monomers that can polymerize with the monomers described above include: (meth)acrylates such as methyl acrylate, ethyl acrylate, isopropyl acrylate, n-propyl acrylate, n-butyl acrylate, t-butyl acrylate, benzyl acrylate, methyl methacrylate, ethyl methacrylate, isopropyl methacrylate, n-propyl methacrylate, n-butyl methacrylate, isobutyl methacrylate, t-butyl methacrylate, tridecyl methacrylate, benzyl methacrylate, 2-ethylhexyl acrylate, 2-ethylhexyl methacrylate, octyl acrylate, octyl methacrylate, lauryl acrylate, lauryl methacrylate, cetyl acrylate, cetyl methacrylate, stearyl acrylate, stearyl methacrylate, behenyl acrylate, and behenyl methacrylate; styrene monomers such as styrene, α-methylstyrene, o-methylstyrene, m-methylstyrene, p-methylstyrene, and p-tert-butylstyrene; itaconates such as benzyl itaconate; maleates such as dimethyl maleate; fumarates such as dimethyl fumarate; acrylonitrile; methacrylonitrile; vinyl acetate; hydroxyl group-containing monomers such as 2-hydroxyethyl acrylate, 2-hydroxyethyl methacrylate, hydroxypropyl acrylate, and hydroxypropyl methacrylate; amino group-containing monomers such as aminoethyl ethylacrylate, aminopropyl acrylate, methacrylamide, aminoethyl methacrylate, aminopropyl methacrylate, dimethylaminoethyl acrylate, and dimethylaminoethyl methacrylate; and α-olefins such as ethylene.

A catalyst to be used in a manufacturing step includes a polymerization initiator. Examples of the catalyst include: peroxides such as t-butylperoxybenzoate, di-t-butylperoxide, cumene hydroperoxide, acetyl peroxide, benzoyl peroxide, and lauroyl peroxide; and azo compounds such as azobisisobutyronitrile, azobis-2,4-dimethylvaleronitrile, and azobiscyclohexanecarbonitrile.

Examples of the non-reactive solvent include: aliphatic hydrocarbon solvents such as hexane and mineral spirit; aromatic hydrocarbon solvents such as benzene, toluene, and xylene; ester solvents such as butyl acetate; alcohol solvents such as methanol and butanol; ketone solvents such as methyl ethyl ketone and isobutyl methyl ketone; and aprotic polar solvents such as dimethylformamide, dimethyl sulfoxide, N-methylpyrrolidone, and pyridine. The solvents listed above may be mixed with each other before use.

Examples of reaction methods include well-known reactions, such as bulk polymerization, solution polymerization, suspension polymerization, emulsion polymerization, and redox polymerization. Of those, the solution polymerization is preferable because of its simple reaction system. The reaction conditions for the solution polymerization vary depending on the kinds of a polymerization initiator and a solvent. Of those, the reaction temperature is desirably 180° C. or less, more desirably in the range of 30 to 150° C. In addition, the reaction time period is desirably in the range of 30 minutes to 40 hours, more desirably in the range of 2 to 30 hours.

Examples of coupling methods for crosslinking include, but not limited to, an ester bond, amino bond, urethane bond, ether bond, and C—C bond caused by a radical reaction. Of those, in terms of reaction rate and reaction time period, stability at the time of toner dispersion, and so on, the ester bond and amino bond are particularly preferable.

Examples of methods for crosslinking the dispersion-facilitating substances for allowing self dispersion include a method using a crosslinking agent and a method for introducing a functional group for crosslinking into a dispersion-facilitating substance. An acrylic polymer compound may require a crosslinking agent because it has only one functional group. The crosslinking agent has only to be reactive to the polar group in the polymer compound. Examples of the crosslinking agent include: amino resins such as a melamine resin, a benzoguanamine resin, and a urea resin; isocyanate resins such as a tolylene diisocyanate prepolymer, multi-functional aromatic polyisocyanate, diphenylmethane diisocyanate, hexamethylene diisocyanate prepolymer, xydilene isocyanate prepolymer, and lysine isocyanate prepolymer; epoxy resins such as acrylic resins each having bisphenol A or a glycidyl group; and chelate compounds for Ti, Al, Zr, and so on. Of those, in terms of the reaction rate, the reaction temperature, and the like, amino resins and epoxy resins are particularly preferable.

Examples of the functional group for crosslinking to be introduced into a dispersion-facilitating substance include an amino group, hydroxy group, methoxy group, and glycidyl group. In terms of the reaction rate and the reaction temperature, the hydroxy group and the glycidyl group are particularly preferable. Examples of methods for introducing a functional group for crosslinking include those well-known in the art such as: a method in which polymerization or condensation is performed using a monomer, polyalcohol, hydroxy amine, polyamine, or the like, each of which has a functional group for crosslinking at the time of synthesis of a polymer compound having an acidic group; and a method in which a prepolymer of a polymer compound having an acidic group is prepared and then a functional group for crosslinking is introduced by polymerization, condensation, or an addition reaction. Needless to say, a dispersion-facilitating substance to which a functional group for crosslinking performs self dispersion.

Examples of a monomer having a functional group for crosslinking to be used in synthesis of a dispersion-facilitating substance allowing self dispersion include: hydroxyl group-containing monomers such as 2-hydroxyethyl acrylate, 2-hydroxyethyl methacrylate, hydroxypropyl acrylate, hydroxypropyl methacrylate, glycerol monomethacrylate, polyethylene glycol monomethacrylate, propylene glycol monomethacrylate, polyethylene glycol monoacrylate, and propylene glycol monoacrylate; glycidyl group-containing monomers such as glycidyl acrylate and glycidyl methacrylate; methoxy group-containing monomers such as methoxypolyethylene glycol acrylate and methoxypolyethylene glycol methacrylate; and amino group-containing monomers such as acrylamide and methacrylamide. Of those, glycidyl group-containing monomers are preferable as the monomers produce hydroxyl groups after reactions to improve the charge.

The compound having a functional group for crosslinking to be introduced by polymerization, condensation, or an addition reaction may have two or more reactive groups, for example polyalcohol, polyamine, hydroxy amine, bisphenol A, and polyisocyanate. In this case, the introduction is carried out by a method in which the prepolymer of a dispersion-facilitating substance allowing self dispersion is synthesized and then the functional group for crosslinking is introduced by polymerization, condensation, or an addition reaction.

An example of the method for synthesizing a basic group-containing charge control agent is as follows. In a reaction vessel equipped with a thermometer and a nitrogen-introducing pipe, 180 parts by weight of dimethyl silicone, 1 part by weight of dimethyl aminomethyl methacrylate, 19 parts by weight of one-end methacryloxy-modified silicone, and 1 part by weight of azobisisobutyronitrile are mixed by agitation, and then the mixture is reacted at 85° C. for 3 hours while being agitated in a stream of nitrogen. Subsequently, the mixture is further reacted at 90° C. for 2 hours to obtain a basic group-containing charge control agent.

An example of the method for synthesizing an acidic group-containing charge control agent is as follows. In a reaction vessel equipped with a thermometer and a nitrogen-introducing pipe, 180 parts by weight of dimethyl silicone, 1 part by weight of methacrylic acid, 19 parts by weight of one-end methacryloxy-modified silicone, and 1 part by weight of azobisisobutyronitrile are mixed by agitation, and then the mixture is reacted at 85° C. for 3 hours while being agitated in a stream of nitrogen. Subsequently, the mixture is further reacted at 90° C. for 2 hours to obtain an acidic group-containing charge control agent. Other charge control agents to be used include: metal salts of dialkyl sulfosuccinate, such as cobalt dialkyl sulfosuccinate, manganese dialkyl sulfosuccinate, zirconium dialkyl sulfosuccinate, yttrium dialkyl sulfosuccinate, and nickel dialkyl sulfosuccinate; metal soaps such as manganese naphthenate, calcium naphthenate, zirconium naphthenate, cobalt naphthenate, ferric naphthenate, lead naphthenate, nickel naphthenate, chromium naphthenate, zinc naphthenate, magnesium naphthenate, manganese octoate, calcium octoate, zirconium octoate, ferric octoate, lead octoate, cobalt octoate, chromium octoate, zinc octoate, magnesium octoate, manganese dodecylate, calcium dodecylate, zirconium dodecylate, ferric dodecylate, lead dodecylate, cobalt dodecylate, chromium dodecylate, zinc dodecylate, and magnesium dodecylate; metal salts of alkylbenzene sulfonate, such as calcium dodecylbenzene sulfonate, sodium dodecylbenzene sulfonate, and barium dodecylbenzene sulfonate; phospholipids such as lecithin and ceharine; and organic amines such as n-decylamine.

The addition amount of the charge control agent may be reduced to a minimum as far as it shows charge-control effects. In general, 0.01 to 50 wt % of the charge control agent is added to the liquid developer. The charge control agent shows charge-control effects even if the addition thereof is performed in the formulation process described latter or after the removal of the solvent, and preferably granulation is performed in the coexistence of the charge control agent. For instance, in the formulation process described below, the charge control agent is added to other raw materials, solvents, or intermediate products before the formulation process, and then the solution of a resin or varnish and an electrically-insulating dispersant are mixed together in the coexistence of colored particles and charge control agent.

In this embodiment, the charge control agent may be used to control the charge amount and/or charge polarity of the toner particles. As described above, in the insulating liquid (the carrier liquid), a chemically non-equilibrium state results in a bias in polarity to increase the charge amount of toner particles, so that the charge control agent is added for complementing the charge amount of the toner in the career liquid.

A liquid developer may be prepared such that the toner particles composed of the respective ingredients described above are mixed and dispersed in a nonpolar nonaqueous solvent. In this case, dispersing means may be a ball mill, a sand mill, an attritor, or the like. In addition, the mixing order is not specifically limited. Furthermore, the control of charge by the charge control agent enables the addition amount thereof to be adjusted appropriately in relation to environmental variations and the like, resulting in an increase in stability.

Examples of a colored substance to be incorporated in toner include inorganic pigments, organic pigments, dyes, fillers, drugs, polymerization initiators, catalysts, and ultraviolet light absorbers.

Examples of the inorganic pigments include carbon black, titanium oxide, zinc white, zinc oxide, tripone, iron oxide, aluminum oxide, silicon dioxide, kaolinite, montmorillonite, talc, barium sulfate, and calcium carbonate. In addition, examples of the inorganic pigments include silica, alumina, cadmium red, colcothar, molybdenum red, chrome vermilion, molybdate orange, chrome yellow, chrome yellow, cadmium yellow, yellow iron oxide, titanium yellow, and chromium oxide. Moreover, examples of the inorganic pigments include pyridian, cobalt green, titanium cobalt green, cobalt chromium green, ultramarine blue, ultramarine blue, iron blue, cobalt blue, cerulean blue, manganese violet, cobalt violet, and mica.

Examples of the organic pigments include azo, azomethine, polyazo, phthalocyanine, quinacridone, anthraquinone, indigo, thioindigo, quinophthalone, benzimidazolone, isoindoline, and isoindolinone pigments. Those pigments may be independently used, or two or more pigments may be selected from those pigments and used in combination if required. The proportion of the pigment in the toner particles of this embodiment is preferably 2 to 20 parts by weight, more preferably 3 to 15 parts by weight per 100 parts by weight of a resin component (polymer). The pigments may receive surface modification.

Surface-modifying agents for pigments may be those well-known in the art including silane-coupling agents, titanium-coupling agents, and aluminum-coupling agents. Examples of the silane-coupling agents include: alkoxy silanes, such as methyltrimethoxy silane, finyltrimethoxy silane, methylfinyldimethoxy silane, and difanyldimethoxy silane; siloxanes, such as hexamethyldisiloxane; γ-chloropropyl trimethoxysilane; vinyltrichlorosilane; vinyltrimethoxy silane; vinyltriethoxy silane; γ-methacryloxy propyl trimethoxysilane; γ-glycidoxypropyl trimethoxysilane; γ-mercaptopropyl trimethoxysilane; γ-aminopropyl triethoxysilane; and γ-ureidopropyl triethoxysilane. The addition amount of the surface-modifying agents is preferably in the range of 0.01 to 20 wt %, more preferably in the range of 0.1 to 5 wt %.

Furthermore, the method for modifying the surface of pigment fine particles may be one in which a surface-modifying agent is added to a dispersion of pigment fine particles and then the dispersion is heated to initiate a reaction. The surface-modified pigment fine particles are collected through filtration and repeatedly subjected to both a filtration treatment and a washing treatment using the same solvent, followed by being subjected to a drying treatment. A substance such as carbon black or a metal oxide, which can be chemically bonded by grafting or the like, may be synthesized just as in the case of the above method.

Examples of dyes include azo, anthraquinone, indigo, phthalocyanine, carbonyl, quinoneimine, methine, quinoline, and nitro dyes. Of those, disperse dyes are particularly preferable.

The nonvolatile liquid used is preferably aprotic. The aprotic liquid is an inert liquid which does not show acidic or basic properties. The aprotic liquid has an electric conductivity due to the dispersion of a conductive material but it reduces the electric resistance thereof when it is dispersed in a solvent. For this reason, the electric resistance which does not interrupt the electrophoresis of toner in an electric field is maintainable. Furthermore, the aprotic liquid preferably has a viscosity of 10 to 1,000 mPa·s, an electric resistance of $1\times10^{12}\Omega\cdot$cm or more, a surface tension of 30 dyne/cm or less, and a boiling point of 100° C. or more.

This is because of the following reason. According to the experiment of the inventors of the present invention, using an aprotic liquid with a viscosity of 1,000 mPa·s or less allows itself to be adsorbed in the paper fibers of the recording medium and thus no soil caused by making dust or the like which adheres to the liquid on the surface of paper fibers is produced on the recording medium after fixation. However, when an aprotic liquid having a viscosity of less than 10 mPa·s is used, the flow of an image will be generated as the toner flows owing to a decrease in viscosity. Furthermore, when an aprotic liquid having a boiling point of less than 100° C. is used, rapid evaporation of moisture may burst a recording medium. Moreover, when the electric resistance is less than $1\times10^{12}\Omega\cdot$cm, an electric current is leaked between toner particles by insulation failure. Therefore, it becomes very difficult to carry out electrophoresis and to develop an electrostatic latent image. Moreover, when the surface tension exceeds 30 dyne/cm, the wettability of the toner worsens rapidly and the toner mass adheres to a latent-image bearing member such as a photoconductor, causing deterioration in image quality such as scumming.

By the way, a system where 15 to 30% of toner is dispersed in a dispersion medium of dimethyl silicone ($1\times10^{14}\Omega\neq$cm) has a specific resistance measured by an impedance method of the order of $10^{6}\Omega\cdot$cm.

Furthermore, it is preferable to use as an aprotic liquid silicone oil containing at least one of phenylmethyl siloxane, dimethyl polysiloxane, and polydimethyl cyclosiloxane. The reason for this is as follows. The silicone oil is extremely inferior in wettability and fixation thereof to a moving member such as an agitating member that applies stress load to the liquid developer may be suppressed. Thus, the frequency of maintenance can be lessened.

Furthermore, considering the generation of charge and the nonvolatile property, the liquid having an electric resistance of $1\times10^{12}\Omega\cdot$cm or more is preferably an aprotic organic solvent selected from: aliphatic hydrocarbons such as mineral spirit and Isopar series available from Exxon Chemicals; silicone oils such as dialkyl polysiloxane and cyclic polydialkyl siloxane; and vegetable oils such as an olive oil, safflower oil, sunflower oil, soybean oil, and linseed oil, and the liquid is more preferably a nonpolar organic solvent having an electric resistance of $1\times10^{12}\Omega\cdot$cm or more. Each of those solvents may be independently used or in combination with one or more other solvents among them.

The amount of the dispersion-facilitating substance adsorbed on the toner can be measured, for example, as follows. After the concentration of the toner in the nonvolatile liquid is adjusted to several percents (%), the liquid developer is centrifuged until a supernatant becomes transparent. Then, the concentration of the dispersion-facilitating substance in the supernatant is measured.

In addition, the dispersion-facilitating substance used is desirably granular because the granular substance can be favorably electrophoresed without resistance even in a high-viscosity liquid. Furthermore, the dispersion-facilitating substance used preferably has an average particle size of 0.001 to 1 μm. If the average particle size is smaller than 0.001 μm, the toner particles will not be covered. If the average particle size is larger than 1 μm, it will be difficult to maintain the dispersion stability of toner particles. Furthermore, the average particle size of the substance can be determined by the conventional equipment for measuring particle-size distribution, which has been generally known in the art, such as a laser- or centrifugal sedimentation-type particle size distribution measuring equipment. The average particle size can be adjusted by, for example, a method in which a precursor of a dispersion-facilitating substance is poured into a ball mill or the like together with a pulverization medium such as a ball and the mixture is pulverized in a dry form. Alternatively, for example, the precursor of the dispersion-facilitating substance may be pulverized in a wet form together with a pulverization medium such as a ball in a solvent. Alternatively, for example, after the precursor of the dispersion-facilitating substance is dissolved in a specific solvent, the substance may be precipitated (e.g., after the substance is dissolved in sulfuric acid, water is added to the resulting solution or the solution is poured in water to generate a precipitate).

Furthermore, it is desirable to use as a group of toner particles to be dispersed in the nonvolatile liquid those of 0.1 to 6.0 μm in volume average particle size and to adjust them to 5 to 40 wt % in concentration. This is because the resolution of an image can be improved in inverse proportion to the toner particle size. In other words, generally, the toner particles reside as aggregates, each of which contains about 5 to 10 particles, on a printed-out recording medium. In addition, a gap between the developing roller and the photoconductor is as narrow as about 10 μm. Considering how many steps of toner layers are made in this gap, the particle size inevitably falls into the above range.

If the toner has an average particle size of 0.1 m or less, physical adhesion between the starting position of the transfer and the toner in the transferring step is excessively strengthened, so that the toner image cannot be transferred to the target place of the transfer, thereby causing white spots on an image. It can be explained by the reasons described below. That is, when the toner becomes small, the migration velocity of the toner particles becomes slow because the toner particles receive the viscous resistance of the dispersion medium. In addition, when the toner further becomes smaller, the influence of the unevenness of the media becomes large and it becomes impossible to keep the image density and the uniformity of an image.

The concentration of the toner particles is defined within the range of 5 to 40 wt % from the following reasons. That is, considering the dispersion, the specific gravity of the dispersion medium and the specific gravity of the colored particles are almost equal to each other. Therefore, the weight ratio and the volume ratio will be almost equal to each other. A concentration in excess of 50% means that some toner particles remain on both the image portion and non-image portion because of contact development. In particular, the toner particles on the non-image portion, which cannot move sufficiently, remain on the photoconductor, so that the non-image portion will be polluted and a large amount of load will be applied on the cleaning device. The weight ratio allows a slight increase in specific gravity of the toner to the dispersion medium, so that 40 wt % will be appropriate for the upper limit of the weight ratio.

In addition to colored particles such as toner and a dispersion-facilitating substance, if required, a liquid developer may further contain a surfactant, antiseptic, deodorizer, leather-stretching inhibitor, flavor, pigment dispersant, pigment derivative, and soon.

A liquid developer can be manufactured by mixing at least toner and a dispersion-facilitating substance with a nonvolatile liquid, precipitating the dispersion-facilitating substance, and adsorbing the precipitant on the toner. Specifically, for example, the mixing step is performed at first. In this step, the toner and the dispersion-facilitating substance are mixed in a solvent in which the dispersion-facilitating substance can be dissolved but the toner cannot be dissolved. Subsequently, the precipitating step is performed. In this step, a liquid in which the dispersion-facilitating substance cannot be dissolved is injected into the mixture obtained at the mixing step to precipitate and adsorb the dispersion-facilitating substance on the surface of toner particles. Furthermore, if required, a crosslinking step for fixing the dispersion-facilitating substance to the surface of the toner particles by crosslinking and a concentrating step for concentrating solid contents by distillation of a liquid fraction.

In the mixing step, after the toner and the dispersion-facilitating substance are mixed in the above solvent, a dispersion medium is optionally added to the mixture. Examples of the dispersion medium include glass beads, steel beads, and zirconia beads. Then, the mixture is subjected to a dispersion device such as: a bead mill such as DYNO-MILL or DSP mill; or a high-pressure discharge mill such as a roll mill, a sand mill, an attritor, a kneader, or a nanomizer to uniformly disperse the toner in the mixture. Furthermore, if required, various additives including a surfactant, a pigment dispersant, a pigment derivative, and a charge generator may be added to the mixture. Conditions for dispersing the toner are depended on the material of the toner or the kind of the dispersing means. However, in terms of cost effectiveness, it is desirable to end the dispersion within a short period of time in the temperature range of 0 to 150° C. A proper dispersion time period is 0.1 to 10 hours per kg. The crosslinking agent for crosslinking the dispersion-facilitating substance may be mixed before the dispersion of toner particles or may be mixed after the dispersion. In this case, however, the influence of an undesired reaction or the like may occur at the time of dispersion. It is preferable to mix the dispersion-facilitating substance after the dispersion if possible. The proportion of the crosslinking agent added to the mixture may be any level as far as the level allows the dispersion-facilitating substance to be crosslinked with and adsorbed on the toner.

In the precipitating step, the liquid in which the dispersion-facilitating substance cannot be dissolved is gradually injected into and mixed with the mixture obtained in the above mixing step. Alternatively, the former liquid may be injected into the mixture. During or after the injection, an agitator such as a three-one-motor, a magnetic stirrer, a disper, or a homogenizer is used to uniformly mix the liquid. A mixer such as a line mixer may be used to mix the former liquid with the mixture at once. After the injection, for fining the precipitated dispersion-facilitating substance more, a dispersion device such as a bead mill or a high-pressure discharge mill may be used.

The liquid in which the dispersion-facilitating substance cannot be dissolved is not specifically limited to as far as it does not dissolve a polymer compound. However, particularly preferable is an organic solvent having a solubility parameter of 7.8 or less. Examples of the organic solvent having a solubility parameter of 7.8 or less include: aliphatic hydrocarbon solvents such as hexane, mineral sprit, and Isopar series available from Exxon Chemicals; silicone solvents such as dialkyl polysiloxane and cyclic polydialkyl siloxane; vegetable oil solvents such as an olive oil, safflower oil, sunflower oil, soybean oil, and linseed oil; and diethyl ether. The proportion of the organic solvent used is 0 to 10,000 parts by weight per 100 parts by weight of the polymer compound in order to increase the concentration of the granular substance in the liquid developer to be manufactured.

The method for crosslinking in the crosslinking step is not specifically limited. For example, the crosslinking method may be of using heating, UV-radiation, electron beams, or the like. In terms of reactivity and simpleness, the method depending on heating is preferable. The temperature of crosslinking with heating is, but not specifically limited to as far as the temperature does not destroy the dispersion state of the toner, preferably 200° C. or less, more preferably 180° C. or less.

Depending on the use of toner, the concentrating step is done appropriately. In addition, the concentrating step may be performed before the crosslinking step. General atmospheric distillation or reduced-pressure distillation is applied for the concentrating method. For instance, in the case of using a silicone liquid as a dispersant, the concentration is performed by atmospheric or reduced-pressure distillation using a solvent capable of dissolving the dispersion-facilitating substance and having a boiling point lower than that of the silicone liquid. In contrast, when the liquid developer is used in an organic solvent capable of dissolving a polymer compound, the concentration is performed by atmospheric or reduced-pressure distillation using a silicone solvent having a boiling point lower than that of the organic solvent. Furthermore, depending on a need, all of them may be distilled or substituted with water, and dried so as to be used for powder coating, toner, plastics, and so on. In the field of liquid toner, there is no need of using a specific charge generator and electric charges are stably fixed on the surface of granular substance. Thus, there is excellent stability in long-term use.

For using the liquid developer in those uses, a binder, an organic solvent, and various kinds of additives are added depending on each use and then the granular substance or binder is adjusted to a predetermined concentration. Binders are those well known in the art, including, but not limited to: natural proteins; cellulose; synthetic polymers such as polyvinyl alcohol, polyacrylamide, aromatic amides, polyacrylic acid, polyvinyl ether, polyvinyl pyrrolidone, acryl, polyester, alkyd, urethane, amide resins, melamine resins, ether resins, fluorine resins, styrene acrylic resin, and styrene maleic acid resins; photosensitive resins; heat-curing resins; UV-curing resins; and electron beam-curing resins.

Various kinds of additives are those well known in the art including, but not limited to: anionic, cationic, and nonionic surfactants; leather-stretching inhibitors; leveling agents; charge control agents such as metal soap and lecithin; and wetting agents.

A simple agitator such as a disper may be used for adding the binder, organic solvent, and various kinds of additives to the liquid developer to adjust the mixture to final liquid toner and thus there is no need of a conventionally-required dispersion device or the like, thereby resulting in energy saving and enabling its production at a low cost. Furthermore, two components, a nonvolatile liquid and a dispersing element, can be changed into one component by modifying the nonvolatile liquid to allow a polar group of the dispersing element as described above to be incorporated.

Furthermore, in a dispersion in which particles of a resin, pigment, magnetic body, or the like are dissolved in an appropriate solvent, stability in dispersion particles is an important problem irrespective of whether the solvent is nonaqueous or aqueous. It is known that such stability in the dispersion particles is generally obtained by the action of an electrostatic effect due to electrostatic repulsion or a steric effect (also called as an adsorption layer effect). DLVO theory has been established for the electrostatic effect. In this theory, the broadening of electric bilayer and a surface potential (so-called ζ potential) are very important factors. Therefore, the dispersion particles require the presence of ions that form them, so that some studies have been conducted on an aqueous solvent system where the existence of ions is clear.

On the other hand, no theory that corresponds to the DLVO theory has been established for the steric effect. With regard to a nonaqueous solvent system (mainly an oil solvent), for example, the study disclosed in "F. A. Waite, J. Oil Col. Chem. Assoc., 54, 342 (1971)" (hereinafter, referred to as Document A) is known in the art. This study relates to a basic manufacturing method of a nonpolar dispersion which is a stable solvent. This manufacturing method is for producing a block or graft copolymer that contains a component having compatibility to dispersion particles (insoluble in the solvent) to be dispersed in the solvent and a component which is soluble in the solvent.

JP 40-07047 B discloses a method for obtaining a nonaqueous-solvent-based dispersion using the above manufacturing method. This method is for obtaining a stable polymethyl methacrylate (PMMA) dispersion by radical polymerization of methyl methacrylate (MMA) in the presence of degradation rubber in a hydrocarbon solvent. In this method, it is not conceivable that the degradation rubber is adsorbed on PMMA particles. Judging from the fact that the PMMA particles are dispersed in a stable manner, MMA is considered to undergo graft polymerization with the degradation rubber. It is conceivable that the dispersion stability of the dispersion particles is maintained because the resulting graft polymer has an insoluble portion on the surface of the dispersion particles and its soluble portion has a steric effect.

JP 08-23005 B describes a method for obtaining a nonpolar-solvent-based dispersion with long-term stability by distinctly charging solid particles with ions in a solvent such as a nonpolar aprotic solvent to thereby allow an electrostatic effect to act synergistically together with a steric effect that has been used in a nonpolar solvent.

Furthermore, JP 2002-212423 A, JP 2002-241624 A, and JP-2002-256133 A describe, with regard to a hydrocarbon or silicone oil dispersion, a dispersion having excellent dispersion stability due to a steric effect and a nonaqueous solvent dispersion capable of improving dispersability with electrostatic repulsion and electrophoresing dispersion particles, respectively.

However, the inventors of the present invention consider the prior art described in those documents and official gazettes as follows. That is, in the case of applying the above dispersion, which is a nonaqueous solvent, to a liquid developer, dispersion particles 5 dispersed in the dispersion correspond to toner particles (colored particles) dispersed in the carrier liquid of the liquid developer. In general, the toner particles have a comparatively large volume average particle size of 0.1 μm or more. Thus, an electrostatic effect due to electrostatic repulsion and a steric effect make it difficult to improve the dispersability of toner particles in the carrier liquid, which is a nonaqueous solvent. Therefore, the toner particles tend to agglutinate as the toner particles come close to each other. When the toner particles tend to agglutinate with each other, the behavior of the toner particles is hardly controlled by an electric field. For instance, when the toner particles agglutinate with each other in a developing area, an electric current flows between the toner particles by a conductive material in the toner particles. Thus, it becomes difficult to move the toner particles toward a latent image even though a developing electric field is formed in the developing area.

Furthermore, the toner particles, which are dispersion particles, have a comparatively large volume average particle size of 0.1 μm or more as described above, so that their charge amounts will be comparatively small. Therefore, it becomes difficult to electrophorese the particles through the nonaqueous solvent at high speed by an electric field such as a developing electric field, resulting in difficulty in acceleration of image-forming speed.

Thus, it is desirable that the toner have, on its surface, a dispersion-facilitating substance, a basic or acidic group, and an affinity group that provides the toner with an affinity to an insulating liquid such as silicone oil. In a liquid developer using such toner, a dispersion-facilitating substance, a basic or acidic group, and an affinity group are provided on the surface of colored particles to be dispersed in a nonpolar insulating liquid to be provided as a nonaqueous solvent. The dispersion-facilitating substance inhibits the agglutination of toner particles. Thus, for example, the dispersion-facilitating substance may be a material for allowing a silicone group to appear on the surface of the toner particles. In this case, the toner particles cannot agglutinate with each other by their silicone groups on the surface thereof and retain a state in which the toner particles are dispersed and spaced with certain distances. Thus, the insulating liquid is placed between the toner particles, so that an insulating state is caused between the toner particles. Therefore, an electric current is difficult to flow between the toner particles even in an electric field, so that it becomes possible to control the behavior of the toner particles with the electric field.

Besides, when the insulating liquid is a silicone solvent, the silicone group functions as an affinity group to provide the toner particles with an affinity to the insulating liquid. As a result, the toner particles become difficult to precipitate in the insulating liquid. Thus, it becomes possible to uniformly disperse the toner particles in the insulating liquid. In addition, the presence of a basic group or an acidic group on the surface of the toner particles makes it possible to ensure the charge amount on the colored particles. When image formation is performed using such a liquid developer, the toner particles can be appropriately controlled with an electric filed at high speed.

Hereinafter, this embodiment will be described in more detail with reference to specific examples and comparative examples. In the following description, "part" and "%" mean "part by weight" and "wt %" unless otherwise specified. In addition, all of reagents without notes used were those of first grade available from Tokyo Kasei Kogyo Co., Ltd.

The toner particles to be used in this embodiment can be manufactured by the following method:

100 parts by weight of methyl methacrylate (MMA), which is a monomer, and 300 parts by weight of water were charged in a four-necked flask (1 litter in volume) attached with a thermometer and a nitrogen-introducing pipe, and then mixed by agitation. Furthermore, the mixture was heated to 80° C. while being stirred in a stream of nitrogen. Subsequently, 0.5 parts by weight of potassium persulfate was added to the mixture, and the resulting mixture was then reacted for 6 hours while the temperature of the mixture was kept at 80° C. to obtain a dispersion (a) of polymer particles. When the polymer particles in the dispersion (a) were observed on an electron micrograph, these polymer particles were spherical in shape and had almost constant particle sizes. The average particle size of the polymer particles was 0.41 μm.

Secondly, 91.7 parts by weight of MMA and 1.0 part by weight of benzoyl peroxide were charged in a four-necked flask (1 litter in volume) attached with a thermometer and a nitrogen-introducing pipe to prepare a solution. Then, 200 parts by weight of water, 3.3 parts by weight of Newcol 707SN (available from Nippon Nyukazai Co., Ltd.), and 0.1 parts by weight of sodium nitrite were added to the solution, and the whole was mixed for 10 minutes under strong agitation. Furthermore, added to the mixture were 35 parts by weight of polymer particles in the dispersion (a) obtained by a first step polymerization. Then, the mixture was gently stirred for 30 minutes at 50° C. and then reacted for 2 hours at 75° C. to obtain a dispersion (b) of polymer particles. The polymer particles in the resulting dispersion (b) were observed on an electron micrograph. As a result, the polymer particles were monodisperse particles in spherical shape and had an average particle size of 0.93 μm.

Next, using a similar device, 95.0 parts by weight of MMA and 1.0 part by weight of benzoyl peroxide were mixed to prepare a solution. Then, 200 parts by weight of water, 3.3 parts by weight of Newcol 707SN (available from Nippon Nyukazai Co., Ltd.), and 0.1 parts by weight of sodium nitrite were added to the resulting solution, and then the whole was mixed for 10 minutes under strong agitation. Subsequently, 15.6 parts by weight of polymer particles in the dispersion (b) were added to the mixture, and the whole was gently stirred for 30 minutes at 50° C., followed by being reacted for 2 hours at 75° C. to obtain a dispersion (c) of polymer particles. The polymer particles in the dispersion (c) were observed on an electron microphotograph. As a result, seed particles in the polymer particles had an average particle size of 2.12 μm and were provided as monodisperse particles in spherical shape.

Furthermore, for coloring, 80.0 parts by weight of methyl methacrylate (MMA) serving as an acrylic monomer, 2.0 parts by weight of C. I. Solvent Blue 35 (solubility to MMA: 4.2 parts by weight) serving as an oil-soluble dye, and 1.0 part by weight of V-601 (available from Wako Pure Chemical Industries, Ltd., dimethyl-2,2'-azobis (2-methyl propionate)) serving as an azo polymerization initiator were charged to prepare a solution. Then, 200 parts by weight of water, 10.0 parts by weight of Newcol 707SN (available from Nippon Nyukazai Co., Ltd.) serving as an emulsifying agent, and 0.05 parts by weight of sodium nitrite serving as a polymerization inhibitor were added to the solution, and the whole was then mixed for 10 minutes under strong agitation.

Subsequently, 62.3 parts by weight of seed particles in the dispersion (c) were added to the mixture, and the whole was gently stirred for 30 minutes at 50° C. After that, the mixture was reacted for 2 hours at 80° C. and then reacted for 2 hours at 90° C. to obtain a dispersion of colored particles. The colored particles in the resulting dispersion were observed on an electron micrograph. As a result, the colored polymer particles had an average particle size of 3.98 μm and were provided as monodisperse particles in spherical shape.

Preferably, the dye is an oil-soluble dye that shows solubility to methyl methacrylate. The concentration of the dye is generally 1.0 part by weight or more, preferably 2.0 parts by weight or more, more preferably 4.0 parts by weight or more per 100 parts by weight of MMA at 25° C.

Examples of oil-soluble dyes which can be preferably used in this embodiment include: oil-soluble dyes having color index numbers (C. I.) of Solvent Blue 35, Solvent Red 132, Solvent Black 27, Solvent Yellow 16, and Solvent Blue 70; OIL GREEN 502 (available from Orient Chemical Industries, LTD.); OIL GREEN BG (available from Orient Chemical Industries, LTD); and VALIFAST RED 3306 (available from Orient Chemical Industries, LTD). Of those, particularly preferable is one having a solubility to MMA of 4.0 parts by weight or more. Furthermore, an oil-soluble dye having a high solubility to MMA is preferably used because the use allows the use of a sufficient amount of dye and results in colored polymer particles having a uniform color tone without causing decolorization of the dye in the step of manufacturing colored polymer particles at polymerization or the like. The oil-soluble dyes may be used individually or in combination.

In this embodiment, the oil-soluble dye can be used at a rate of 1.0 to 20 parts in general, preferably 2.0 to 10 parts per 100 parts by weight of an acrylic monomer, although the rate varies depending on a desired color tone.

SYNTHESIS EXAMPLE 1 (PREPARATION OF POLYMER COMPOUND)

180 parts of Isopar L (available from Exxon Co., Ltd.) were stirred in a reaction vessel. Then, 14 parts of methamethyl methacrylate, 2 parts of methacrylic acid, 4 parts of lauryl methacrylate, and 1 part of azobisisobutyronitrile (available from Wako Pure Chemical Industries, Ltd.) were dropped into the reaction vessel to react them under reflux of argon gas for 5 hours at 85° C. The monomer in the solution after the reaction was treated with ethyl alcohol and then a direct voltage was applied to the polymer dispersion. Consequently, all of the dispersion particles were electrodeposited on an anode plate.

SYNTHESIS EXAMPLE 2 (PREPARATION OF POLYMER COMPOUND)

180 parts of Isopar L (available from Exxon Co., Ltd.) were stirred in a reaction vessel. Then, 14 parts of methamethyl methacrylate, 2 parts of dimethyl aminomethyl methacrylic acid, 4 parts of lauryl methacrylate, and 1 part of azobisisobutyronitrile (available from Wako Pure Chemical Industries, Ltd.) were dropped into the reaction vessel to react them under reflux of argon gas for 5 hours at 85° C. The monomer in the solution after the reaction was treated with ethyl alcohol and then a direct voltage was applied to the polymer dispersion. Consequently, all of the dispersion particles were electrodeposited on a cathode plate.

SYNTHESIS EXAMPLE 3 (PREPARATION OF POLYMER COMPOUND)

180 parts of dimethyl silicone KF-96-1.0 (available from Shin-Etsu Chemical Co., Ltd.) were stirred in a reaction vessel. Then, 14 parts of methamethyl methacrylate, 2 parts of methacrylic acid, 4 parts of one-end methacryloxy-modified silicone FM0711 (available from Chisso Corp.), and 1 part of azobisisobutyronitrile (available from Wako Pure Chemical Industries, Ltd.) were dropped into the reaction vessel to react them under reflux of argon gas for 5 hours at 85° C. The monomer in the solution after the reaction was treated with ethyl alcohol and then a direct voltage was applied to the polymer dispersion. Consequently, all of the dispersion particles were electrodeposited on the anode plate.

SYNTHESIS EXAMPLE 4 (PREPARATION OF POLYMER COMPOUND)

180 parts of dimethyl silicone KF-96-1.0 (available from Shin-Etsu Chemical Co., Ltd.) were stirred in a reaction vessel. Then, 14 parts of methamethyl methacrylate, 2 parts of dimethyl aminomethyl methacrylic acid, 4 parts of one-end methacryloxy-modified silicone FM0711 (available from Chisso Corp.), and 1 part of azobisisobutyronitrile (available from Wako Pure Chemical Industries, Ltd.) were dropped into the reaction vessel to react them under reflux of argon gas for 5 hours at 85° C. The monomer in the solution after the reaction was treated with ethyl alcohol and then a direct voltage was applied to the polymer dispersion. Consequently, all of the dispersion particles were electrodeposited on the cathode plate.

SYNTHESIS EXAMPLE 5 (PREPARATION OF NON-SELF-DISPERSION TYPE POLYMER COMPOUND)

180 parts of dimethyl silicone KF-96-1.0 (available from Shin-Etsu Chemical Co., Ltd.) were stirred in a reaction vessel. Then, 14 parts of methamethyl methacrylate, 2 parts of dimethyl aminomethyl methacrylic acid, 4 parts of n-butyl methacrylate, and 1 part of azobisisobutyronitrile (available from Wako Pure Chemical Industries, Ltd.) were dropped into the reaction vessel to react them under reflux of argon gas for 5 hours at 85° C. The monomer in the solution after the reaction was treated with ethyl alcohol and then a direct voltage was applied to the polymer dispersion. Consequently, all of the dispersion particles were electrodeposited on the cathode plate.

SYNTHESIS EXAMPLE 6 (PREPARATION OF NON-SELF-DISPERSION TYPE POLYMER COMPOUND)

180 parts of dimethyl silicone KF-96-1.0 (available from Shin-Etsu Chemical Co., Ltd.) were stirred in a reaction vessel. Then, 14 parts of methamethyl methacrylate, 2 parts of dimethyl aminomethyl methacrylic acid, 4 parts of one-end methacryloxy-modified silicone TM0701 (manufactured by Chisso Corp.), and 1 part of azobisisobutyronitrile (available from Wako Pure Chemical Industries, Ltd.) were dropped into the reaction vessel to react them under reflux of argon gas for 5 hours at 85° C. The monomer in the solution after the reaction was treated with ethyl alcohol and then a direct voltage was applied to the polymer dispersion. Consequently, all of the dispersion particles were electrodeposited on the cathode plate.

SPECIFIC EXAMPLE 1

Figure 4:
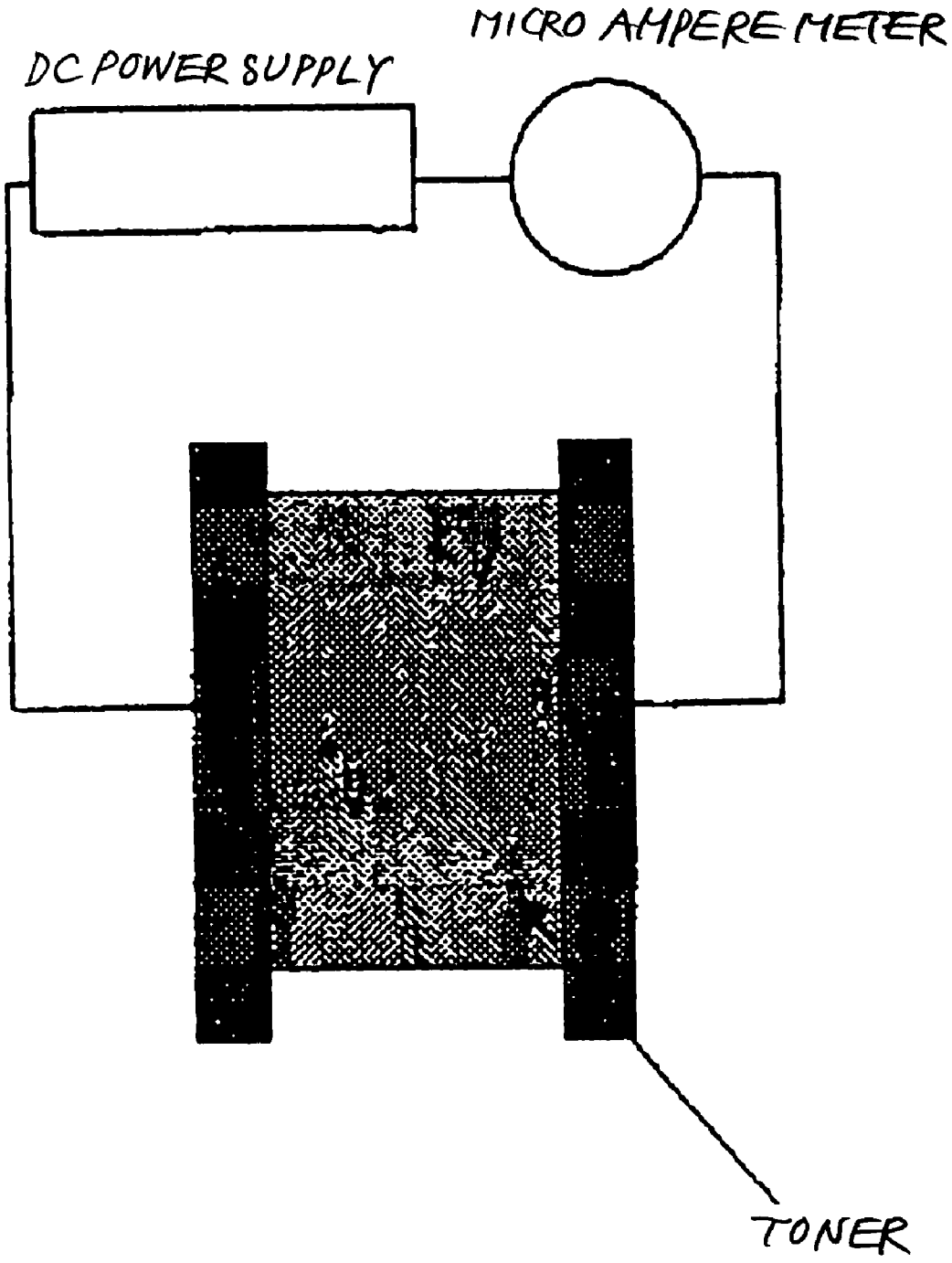
FIG. 4 is a diagram showing an evaluation device used for the measurement of a migration current with a measuring cell.

An acrylic resin mainly composed of methamethyl methacrylate containing dimethyl aminomethyl methacrylic acid was subjected to seed polymerization to obtain positively-charged monodisperse particles of 4 μm in particle size as toner particle substances. Furthermore, 2-ethylhexyl methacrylate was subjected to graft polymerization with the surface of the particles. Then, 20.0 parts by weight of the toner resin particles and 30.0 parts by weight of the polymer compound of Synthesis Example 1 were weighed and then dispersed with Paint Shaker (manufactured by Eishin Co., Ltd.) for 2 hours. After that, 50.0 parts by weight of Isopar H (available from Exxon Co., Ltd.) were additionally mixed to obtain dispersion slurry. For the measurement on a migration current with a measuring cell, an evaluation device shown in FIG. 4 was used. The resulting liquid developer showed good dispersability. When a direct voltage was applied to the dispersion, all of the toner particles were electrodeposited on the cathode plate, resulting in a transparent liquid. When the electrodeposited toner resins were fixed by a heat roller, the resins showed good film performance between them.

SPECIFIC EXAMPLE 2

An acrylic resin mainly composed of methamethyl methacrylate containing methacrylic acid was subjected to seed polymerization to obtain negatively-charged monodisperse particles of 4 μm in particle size as toner particle substances. Furthermore, 2-ethylhexyl methacrylate was subjected to graft polymerization with the surface of the particles. Then, 20.0 parts by weight of the toner resin particles and 30.0 parts by weight of the polymer compound of Synthesis Example 2 were weighed and then dispersed with Paint Shaker (manufactured by Eishin Co., Ltd.) for 2 hours. After that, 50.0 parts by weight of Isopar H (available from Exxon Co., Ltd.) were additionally mixed to obtain dispersion slurry. The resulting liquid developer showed good dispersability. When a direct voltage was applied to the dispersion, all of the toner particles were electrodeposited on the anode plate, resulting in transparent liquid. When the electrodeposited toner resins were fixed by a heat roller, the resins showed good film performance between them.

COMPARATIVE EXAMPLE 1

An acrylic resin mainly composed of methamethyl methacrylate containing methacrylic acid was subjected to seed polymerization to obtain negatively-charged monodisperse particles of 4 μm in particle size as toner particle substances. Furthermore, 2-ethylhexyl methacrylate was subjected to graft polymerization with the surface of the particles. Then, 20.0 parts by weight of the toner resin particles and 30.0 parts by weight of the polymer compound of Synthesis Example 6 were weighed and then dispersed with Paint Shaker (manufactured by Eishin Co., Ltd.) for 2 hours. After that, 50.0 parts by weight of Isopar H (available from Exxon Co., Ltd.) were additionally mixed to obtain dispersion slurry. The resulting liquid developer was poor in dispersability because of its rapid precipitation. In addition, when the toner resin contained a pigment or dye, current leak occurred because of poor dispersability. Application of a direct voltage to the dispersion prevented the migration of toner particles due to an electric field, so that the liquid was opaque even though the toner particles were electrodeposited on the anode plate.

SPECIFIC EXAMPLE 3

An acrylic resin mainly composed of methamethyl methacrylate containing dimethyl aminomethyl methacrylic acid was subjected to seed polymerization to obtain positively-charged monodisperse particles of 4 μm in particle size as toner particle substances. Furthermore, one-end methacryloxy-modified silicone FM0711 (available from Chisso Corp.) was subjected to graft polymerization with the surface of the particles. Then, 20.0 parts by weight of the toner resin particles and 30.0 parts by weight of the polymer compound of Synthesis Example 3 were weighed and then dispersed with Paint Shaker (manufactured by Eishin Co., Ltd.) for 2 hours. After that, 50.0 parts by weight of KF96-50 were additionally mixed to obtain dispersion slurry. The resulting liquid developer showed good dispersability. When a direct voltage was applied to the dispersion, all of the toner particles were electrodeposited on the cathode plate, resulting in a transparent liquid. When the electrodeposited toner resins were fixed by a heat roller, the resins showed good film performance between them. Furthermore, the dispersion was heated and kept at 80° C., followed by application of an electric field. All of the toner particles were electrodeposited on the cathode plate, and the electrodeposited toner resins showed higher ability of agglutination with each other than that of unheated resins. When the electrodeposited toner resins were fixed by a heat roller, the resins showed improved film performance between them.

SPECIFIC EXAMPLE 4

An acrylic resin mainly composed of methamethyl methacrylate containing methacrylic acid was subjected to seed polymerization to obtain negatively-charged monodisperse particles of 4 μm in particle size as toner particle substances. Furthermore, one-end methacryloxy-modified silicone FM0711 (available from Chisso Corp.) was subjected to graft polymerization with the surface of the particles. Then, 20.0 parts by weight of the toner resin particles and 30.0 parts by weight of the polymer compound of Synthesis Example 4 were weighed and then dispersed with Paint Shaker (manufactured by Eishin Co., Ltd.) for 2 hours. After that, 50.0 parts by weight of KF96-50 were additionally mixed to obtain dispersion slurry. The resulting liquid developer showed good dispersability. When a direct voltage was applied to the dispersion, all of the toner particles were electrodeposited on the anode plate, resulting in transparent liquid. When the electrodeposited toner resins were fixed by a heat roller, the resins showed good film performance between them. Furthermore, the dispersion was heated and kept at 80° C., followed by application of an electric field. All of the toner particles were electrodeposited on the anode plate, and the electrophoresed toner resins showed higher ability of agglutination with each other than that of unheated resins. When the electrodeposited toner resins were fixed by a heat roller, the resins showed improved film performance between them.

COMPARATIVE EXAMPLE 2

An acrylic resin mainly composed of methamethyl methacrylate containing methacrylic acid was subjected to seed polymerization to obtain negatively-charged monodisperse particles of 4 μm in particle size as toner particle substances. Furthermore, one-end methacryloxy-modified silicone FM0711 (available from Chisso Corp.) was subjected to graft polymerization with the surface of the particles. Then, 20.0 parts by weight of the toner resin particles and 30.0 parts by weight of the polymer compound of Synthesis Example 5 were weighed and then dispersed with Paint Shaker (manufactured by Eishin Co., Ltd.) for 2 hours. After that, 50.0 parts by weight of KF96-50 were additionally mixed to obtain dispersion slurry. The resulting liquid developer was poor in dispersability because of its rapid precipitation. In addition, when the toner resin contained a pigment or dye, current leak occurred because of poor dispersability. Application of a direct voltage to the dispersion prevented the migration of toner particles due to an electric field, so that the liquid was opaque even though the toner particles were electrodeposited on the anode plate.

With regard to Specific Examples 3 and 4, the mobility of toner by the electrodeposition current and the fixing ability of migrated toner were observed with respect to the percentage compositions shown in FIG. 5.

SPECIFIC EXAMPLE 5

180 parts by weight of dimethyl silicone, 16 parts by weight of colored particles, 1 part by weight of dimethyl aminomethyl methacrylate, 2 parts by weight of one-end methacryloxy-modified silicone, and 1 part by weight of azobisvaleronitrile were added in a reaction vessel attached with a thermometer and a nitrogen-introducing pipe, and the whole was mixed by agitation. Then, the mixture was reacted for 10 hours at 50° C. while being stirred in a stream of nitrogen. Subsequently, 30 parts by weight of the resulting toner particles were added to 70 parts by weight of dimethyl silicone (100 cSt) as an insulating liquid and dispersed by an ultrasonic wave to obtain a liquid developer.

It was revealed that the toner particles had outstanding characteristics of being hard to agglutinate with each other. The inventors of the present invention have verified on this point. It is conceivable that the toner particles have characteristics of being hard to agglutinate with each other because the surface of the toner particles have silicone groups of the one-end methacryloxy-modified silicone provided as a dispersion-facilitating substance.

Furthermore, when a direct voltage was applied to the liquid developer, all of the particles (toner particles) in the liquid developer were immediately electrodeposited on the cathode plate by electrophoresis and the liquid became transparent. The inventors of the present invention have verified on this point. It is conceivable that the high speed electrophoresis has become possible because the charge amount of plus polarity has been increased by the basic group of dimethyl aminomethyl methacrylate on the surface of the toner particles.

SPECIFIC EXAMPLE 6

180 parts by weight of dimethyl silicone, 17 parts by weight of colored particles, 1 part by weight of methacrylic acid, 2 parts by weight of one-end methacryloxy-modified silicone, and 1 part by weight of azobisvaleronitrile were added in a reaction vessel attached with a thermometer and a nitrogen-introducing pipe, and the whole was mixed by agitation. Then, the mixture was reacted for 10 hours at 50° C. while being stirred in a stream of nitrogen. Subsequently, 30 parts by weight of the resulting toner particles were added to 70 parts by weight of dimethyl silicone (100 cSt) as an insulating liquid and dispersed by an ultrasonic wave to obtain a liquid developer.

It was revealed that the toner particles had outstanding characteristics of being hard to agglutinate with each other. The reason therefor is the same as that in Specific Example 5 described above.

Furthermore, when a direct voltage was applied to the liquid developer, all of the particles (toner particles) in the liquid developer were immediately electrodeposited on the anode plate by electrophoresis and the liquid became transparent. The inventors of the present invention have verified on this point. It is conceivable that the high speed electrophoresis has become possible because the charge amount of minus polarity has been increased by the acidic group of methacrylic acid on the surface of the toner particles.

COMPARATIVE EXAMPLE 3

Next, a description is given of Comparative Example 3, which is an experiment for making a comparison between the liquid developer of Specific Example 5 and a liquid developer described below.

180 parts by weight of dimethyl silicone, 17 parts by weight of colored particles, 1 part by weight of dimethyl aminomethyl methacrylate, and 1 part by weight of azobisvaleronitrile were added in a reaction vessel attached with a thermometer and a nitrogen-introducing pipe, and the whole was mixed by agitation. Then, the mixture was reacted for 10 hours at 50° C. while being stirred in a stream of nitrogen. Subsequently, 30 parts by weight of the resulting toner particles were added to 70 parts by weight of dimethyl silicone (100 cSt) as an insulating liquid and dispersed by an ultrasonic wave to obtain a liquid developer.

When a direct voltage was applied to the liquid developer, just as in the case of Specific Example 5 described above, all of the particles (toner particles) in the liquid developer were immediately electrodeposited on the cathode plate by electrophoresis and the liquid became transparent.

Here, the toner particles immediately precipitate in the insulating liquid (dimethyl silicone) if there is no affinity group (silicone group) having an affinity to the insulating liquid on the surface of the toner particles. In this case, appropriate image formation becomes difficult. It is important that the molecular weight of the one-end methacryloxy-modified silicone having the affinity group correspond to the molecular weight of the insulating liquid. The molecular weight of dimethyl silicone (100 cSt) used in Specific Example 1 described above is in the order of several thousands on average. On the other hand, it is possible to retain the dispersability of the one-end methacryloxy-modified silicone used in Specific Example 5 described above when the molecular weight of the material used is 1,000, 5,000, or 10,000. However, extremely poor dispersability is caused when the molecular weight thereof is as small as about 400. Even in the case where the molecular weight is 1,000, which is better than the case where the molecular weight is 400, the dispersability of the material is insufficient a little and precipitation will occur after several months passed, although they depend on a graft time period. Consequently, it is desirable that the molecular weight of the one-end methacryloxy-modified silicone be at least on the same order as that of the average molecular weight of the insulating liquid.

Figure 6A:
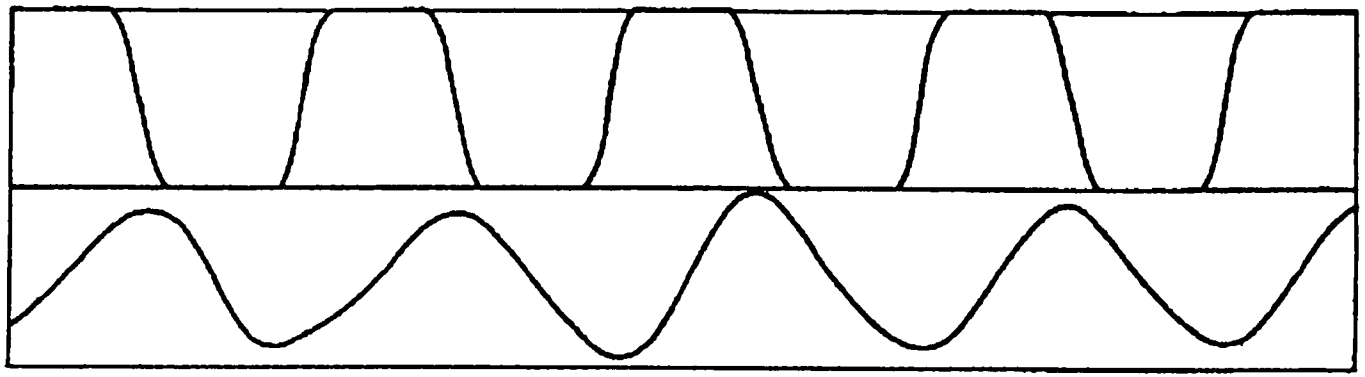
FIG. 6A is a graphical representation of the results obtained by observing response characteristics of toner particles when the liquid developer of Specific Example 5 is placed in an alternating electric field.
Figure 6B:
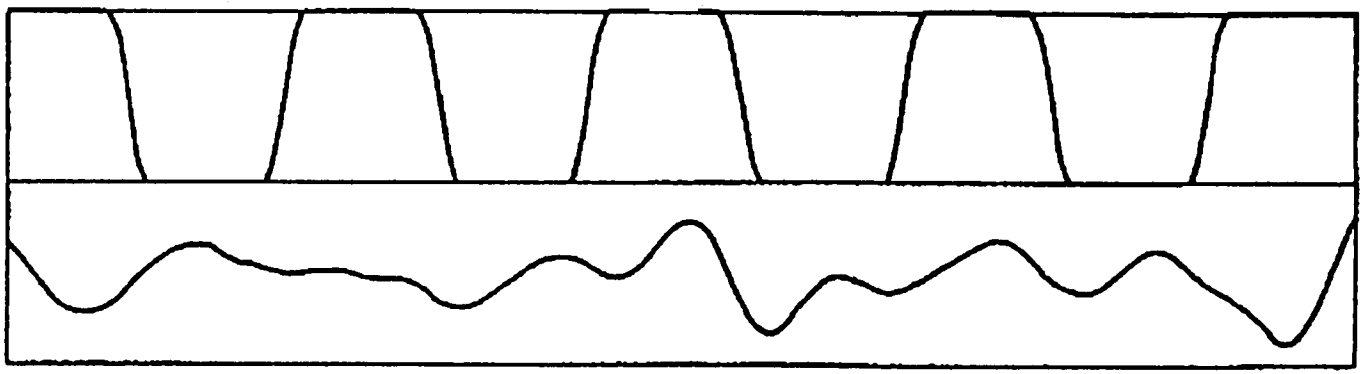
FIG. 6B is a graphical representation of the results obtained by observing response characteristics of toner particles when the liquid developer of Comparative Example 3 is placed in the alternating electric field.

FIGS. 6A and 6B each show a graph that represents the results of observation of the response characteristics of toner particles when each of the liquid developers of Specific Example 5 and Comparative Example 3 is placed in an alternating electric field.

FIG. 6A shows the results of observation with respect to the liquid developer of Specific Example 5, and FIG. 6B shows the results of observation with respect to the liquid developer of Comparative Example 3. The upper portion of each graph represents the waveform of the alternating electric field and the lower portion thereof represents the results of observation of the pressure waveform of the toner particles moving in response to the alternating electric field. Like Comparative Example 3, in the case of the toner particles which do not have an affinity group, the response to the electric field is not satisfied as shown in FIG. 6B. However, it was confirmed that, in the case of the toner particles which have affinity groups just as in the case of Specific Example 5 the response to the electric field is good as shown in FIG. 6A.

Furthermore, 180 parts by weight of dimethyl silicone, 17 parts by weight of colored particles, 1 part by weight of methacrylic acid, and 1 part by weight of azobisvaleronitrile were added in a reaction vessel attached with a thermometer and a nitrogen-introducing pipe, and the whole was mixed by agitation. Then, the mixture was reacted for 10 hours at 50° C. while being stirred in a stream of nitrogen. Subsequently, 30 parts by weight of the resulting toner particles were added to 70 parts by weight of dimethyl silicone (100 cSt) as an insulating liquid and dispersed by an ultrasonic wave to obtain a liquid developer. The liquid developer was different from one obtained in Specific Example 6 in that the former did not have any affinity group. In addition, a comparative experiment with the liquid developer of Specific Example 6 showed the same observations as those described above.

COMPARATIVE EXAMPLE 4

180 parts by weight of dimethyl silicone, 17 parts by weight of colored particles with small particle sizes (0.09 μm in volume average particle size), 1 part by weight of dimethyl aminomethyl methacrylate, 2 parts by weight of one-end methacryloxy-modified silicone, and 1 part by weight of azobisvaleronitrile were added in a reaction vessel attached with a thermometer and a nitrogen-introducing pipe, and the whole was mixed by agitation. Then, the mixture was reacted for 10 hours at 50° C. while being stirred in a stream of nitrogen. Subsequently, 30 parts by weight of the resulting toner particles were added to 70 parts by weight of dimethyl silicone (100 cSt) as an insulating liquid and dispersed by an ultrasonic wave to obtain a liquid developer. When a direct voltage was applied to the liquid developer, just as in the case of Specific Example 5 described above, all of the particles (toner particles) in the liquid developer were immediately electrodeposited on the cathode plate by electrophoresis and the liquid became transparent. However, as the particle size of the toner particles in the liquid developer is small, the viscous resistance per particle to the charge amount is large. Thus, the toner particles are difficult to move at high speed in the insulating liquid even in an electric field.

Further, 180 parts by weight of dimethyl silicone, 17 parts by weight of colored particles with large particle sizes (10 μm in volume average particle size), 1 part by weight of dimethyl aminomethyl methacrylate, 2 parts by weight of one-end methacryloxy-modified silicone, and 1 part by weight of azobisvaleronitrile were added in a reaction vessel attached with a thermometer and a nitrogen-introducing pipe, and the whole was mixed by agitation. Then, the mixture was reacted for 10 hours at 50° C. while being stirred in a stream of nitrogen. Subsequently, 30 parts by weight of the resulting toner particles were added to 70 parts by weight of dimethyl silicone (100 cSt) as an insulating liquid and dispersed by an ultrasonic wave to obtain a liquid developer. When a direct voltage was applied to the liquid developer, just as in the case of Specific Example 5 described above, all of the particles (toner particles) in the liquid developer were electrodeposited on the cathode plate by electrophoresis and the liquid became transparent. However, as the toner particle size has become large, it becomes difficult to form an image at high resolution.

In each of Specific Examples 1 to 6 described above and Specific Examples 7 to 13 described below, the colored particles used has a volume average particle size of 0.1 μm or more and 6.0 μm or less. Therefore, the electric field allows the toner particles to move at high speed in the insulating liquid, which is sufficient to enable image formation at high resolution.

SPECIFIC EXAMPLE 7

180 parts by weight of dimethyl silicone, 17 parts by weight of colored particles, 1 part by weight of dimethyl aminomethyl methacrylate, 2 parts by weight of one-end methacryloxy-modified silicone, and 1 part by weight of azobisvaleronitrile were added in a reaction vessel attached with a thermometer and a nitrogen-introducing pipe, and the whole was mixed by agitation. Then, the mixture was reacted for 10 hours at 50° C. while being stirred in a stream of nitrogen. Subsequently, 30 parts by weight of the resulting toner particles as well as 2 parts by weight of an acidic group-containing charge control agent were added to 68 parts by weight of dimethyl silicone (100 cSt) as an insulating liquid and dispersed by an ultrasonic wave to obtain a liquid developer.

Just as in the case of Specific Example 5 described above, the toner particles have outstanding characteristics of being hard to agglutinate with each other. In addition, when a direct voltage was applied to the liquid developer, all of the particles (toner particles) in the liquid developer were quickly electrodeposited on the cathode plate by electrophoresis and the liquid became transparent. At this time, in the liquid developer of Specific Example 7, an increase in moving speed was confirmed, comparing with the liquid developer of Specific Example 5 free of acidic group-containing charge control agent. The increase is probably attributed to the influence of the dispersion of an acidic group-containing charge control agent having polarity opposite to the charge polarity of toner particles in the insulating liquid.

Figure 7:
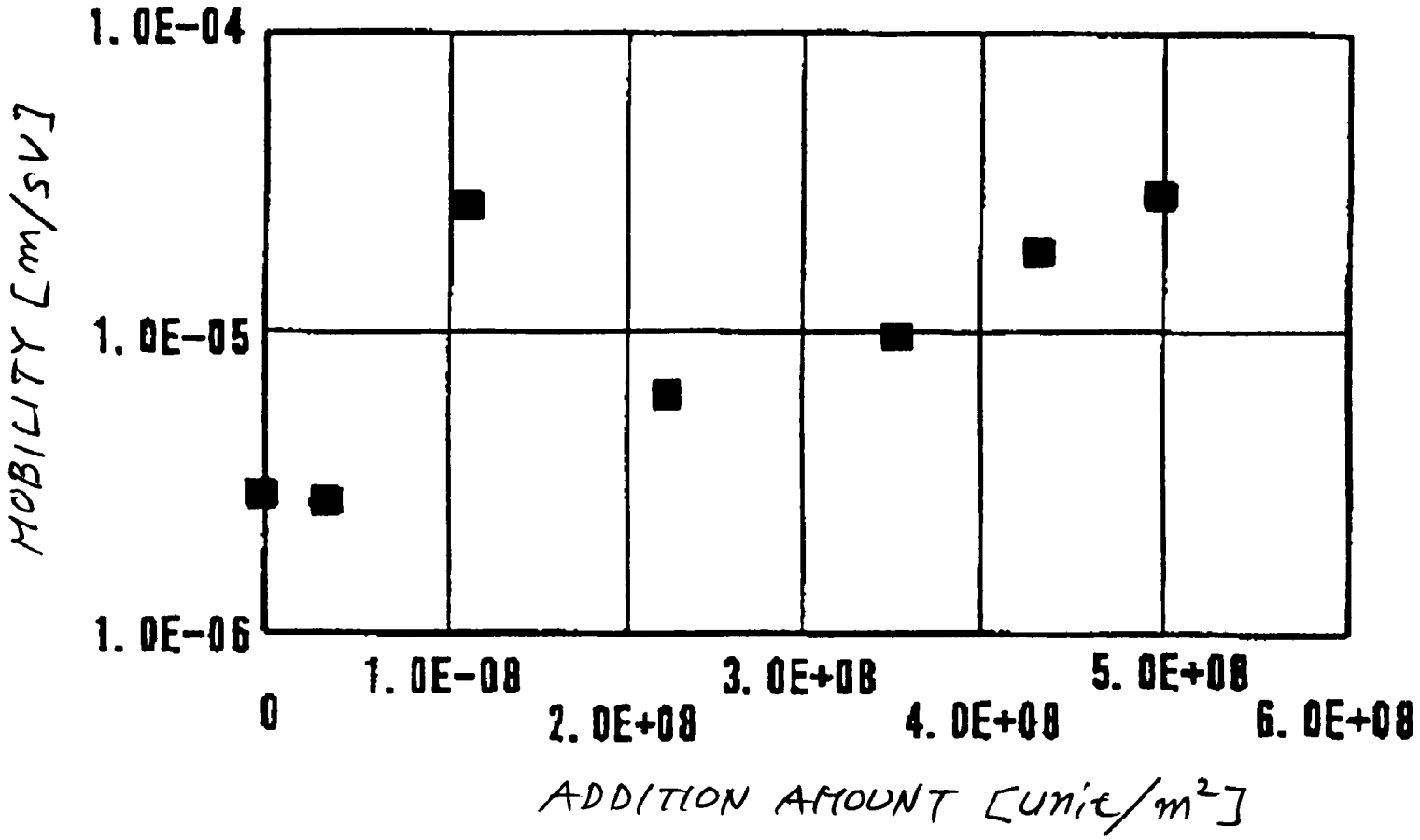
FIG. 7 is a graphical representation of a relationship between an addition amount of an acidic group-containing charge control agent and mobility of toner particles in Specific Example 7.

FIG. 7 is a graph that represents the relationship between the addition amount of an acidic group-containing charge control agent and the mobility of the toner particles. As shown in the figure, the mobility of the toner particles tends to increase as the addition amount of the charge control agent increases. However, when the addition amount of the acidic group-containing charge control agent exceeds $5\times10^{16}$ units/$m^2$ with respect to the surface area of the toner, some toner particles begin to invert their polarity. Therefore, the optimum amount exists and it is necessary to adjust to the optimum amount. On the other hand, when a large amount of acidic group-containing charge control agent is incorporated, even if the toner particles have basic groups on their surface, they may be also used as toner having minus polarity.

Figure 8:
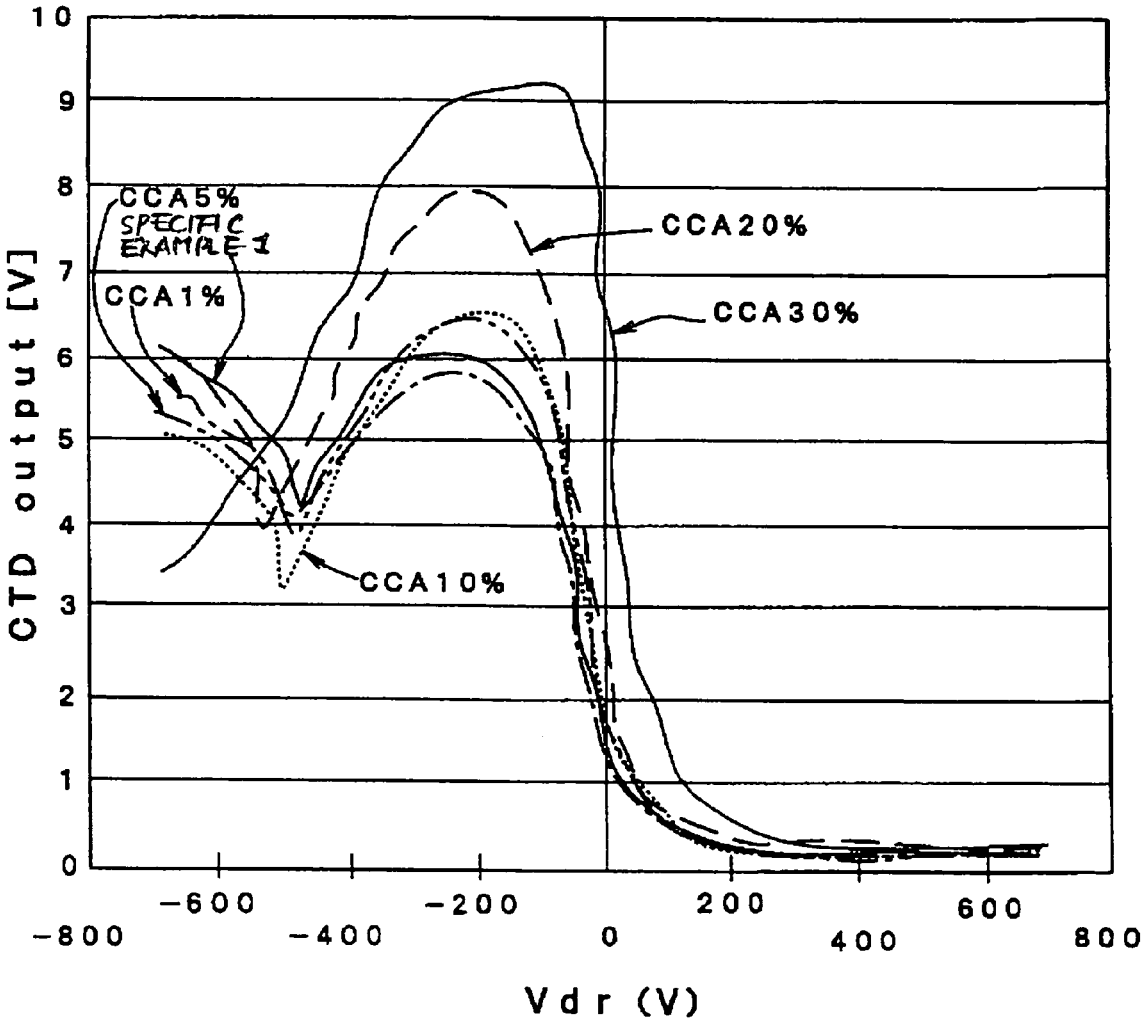
FIG. 8 is a graphical representation of a relationship between a bias level applied to a developing roller and the mobility of toner particles in Specific Example 7.

FIG. 8 is a graphical representation of the relationship between the bias level applied to the developing roller 17 and the mobility of toner particles. By the way, the addition amount of the acidic group-containing charge control agent (CCA) is 1/10 of the introductory notes. It would be ideal 0 V be shown when a positive bias is impressed to the developing roller 17 and 9 V be shown when a negative bias is impressed. The results get close to the ideal when the addition amount of the acidic group-containing charge control agent increases compared with the liquid developer of Specific Example 5.

Figure 9:
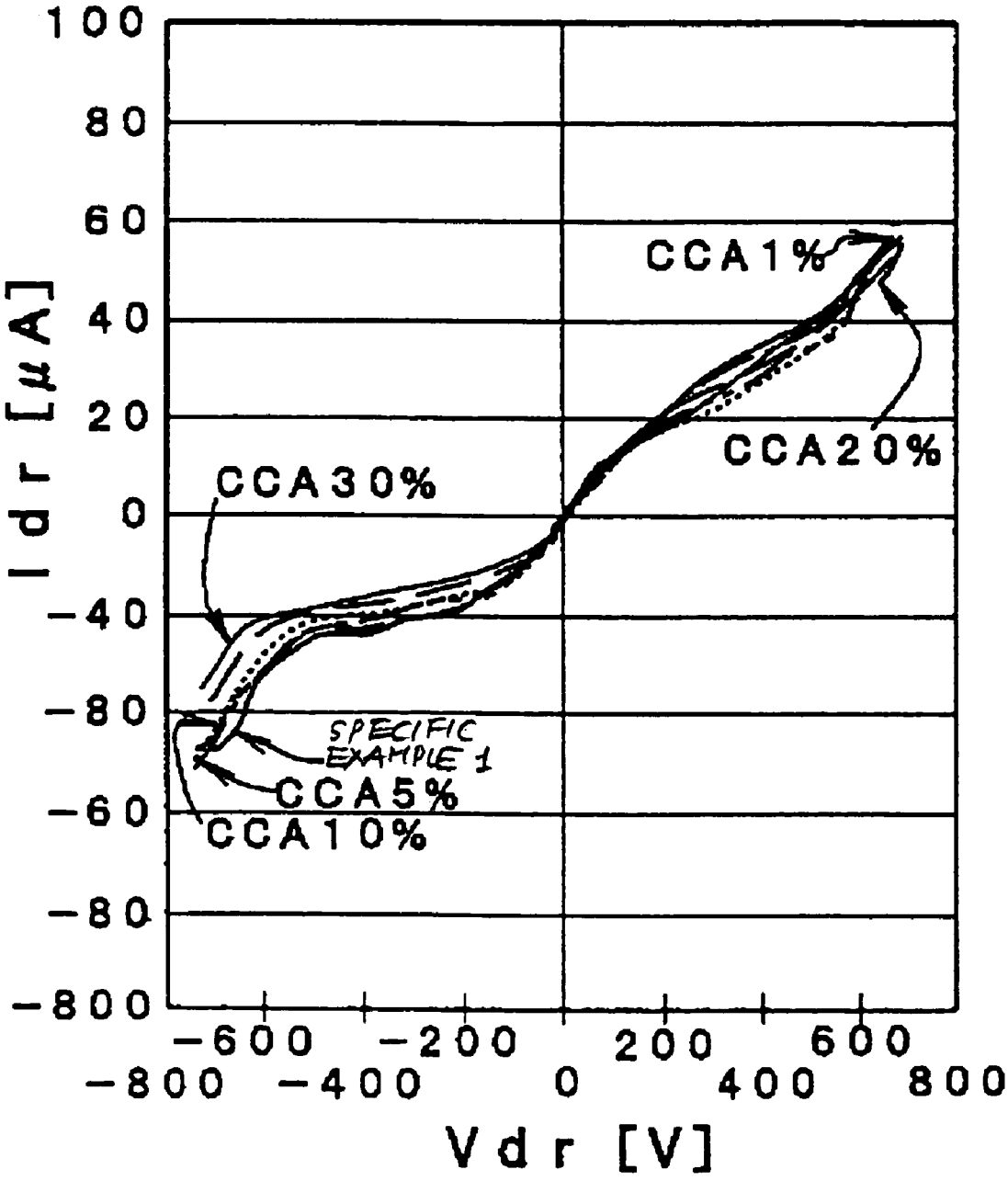
FIG. 9 is a graphical representation of a relationship between the bias level applied to the developing roller and an amount of current flowing between a photoconductive member and the developing roller in Specific Example 7.

FIG. 9 is a graphical representation of the relationship between the bias level applied to the developing roller 17 and the amount of current flowing between the photoconductor 1 and the developing roller 17. By the way, the addition amount of the acidic group-containing charge control agent (CCA) is 1/10 of the introductory notes. The amount of current flowing between the photoconductor 1 and the developing roller 17 was lowered by the addition of the acidic group-containing charge control agent which had polarity opposite to the toner particles having basic groups on their surface. Thus, it was observed that the superfluous ions were inhibited. As a result, the toner particles can be appropriately migrated by a developing electric field because the electric potential difference between the photoconductor 1 and the developing roller 17 is not narrowed.

SPECIFIC EXAMPLE 8

180 parts by weight of dimethyl silicone, 17 parts by weight of colored particles, 1 part by weight of dimethyl aminomethyl methacrylate, 2 parts by weight of one-end methacryloxy-modified silicone, and 1 part by weight of azobisvaleronitrile were added in a reaction vessel attached with a thermometer and a nitrogen-introducing pipe, and the whole was mixed by agitation. Then, the mixture was reacted for 10 hours at 50° C. while being stirred in a stream of nitrogen. Subsequently, 30 parts by weight of the resulting toner particles as well as 30 parts by weight of a basic group-containing charge control agent were added to 40 parts by weight of dimethyl silicone (100 cSt) as an insulating liquid and dispersed by an ultrasonic wave to obtain a liquid developer. Just as in the case of Specific Example 5 described above, the toner particles have outstanding characteristics of being hard to agglutinate with each other.

Figure 10:
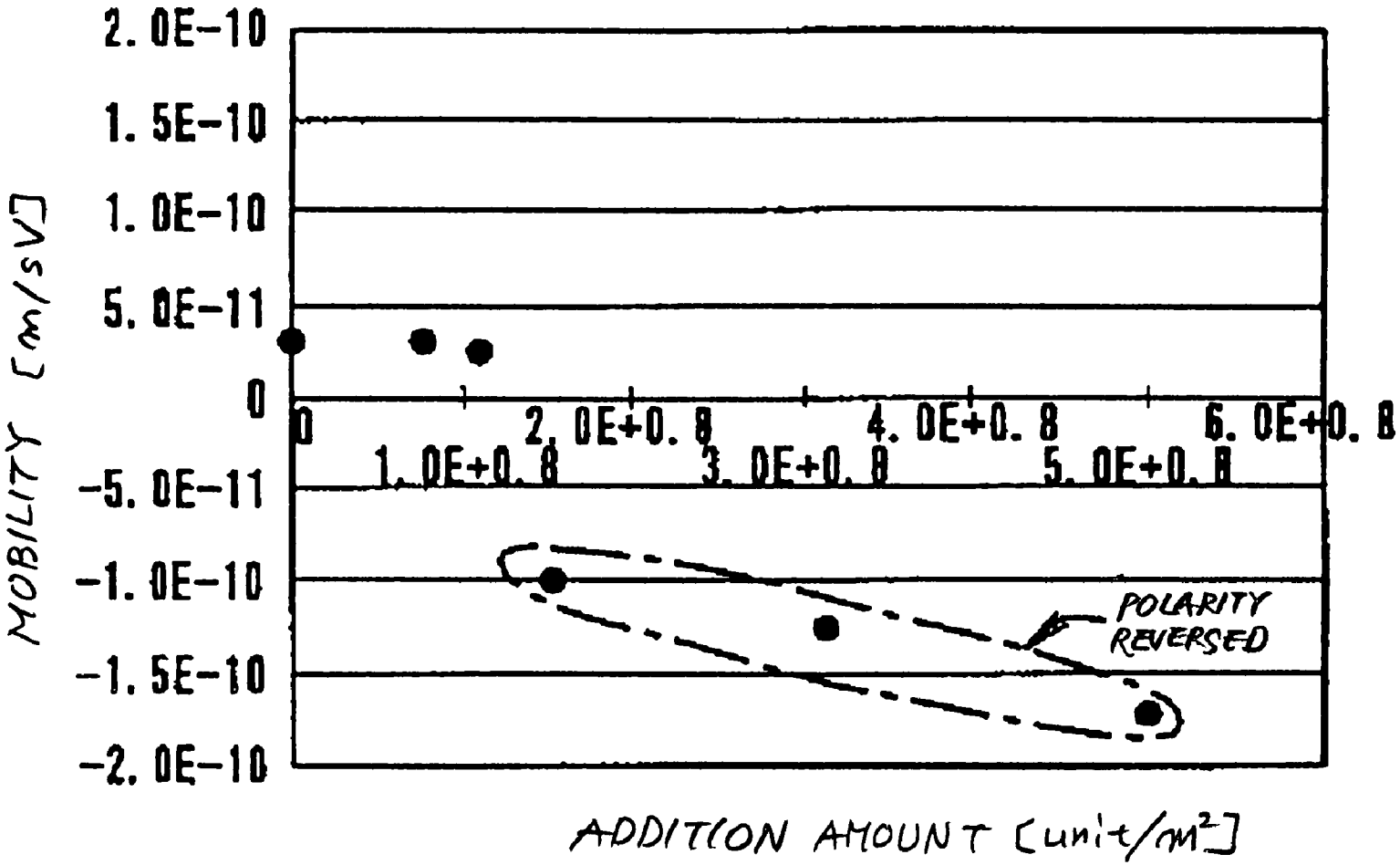
FIG. 10 is a graphical representation of a relationship between an addition amount of a basic group-containing charge control agent and mobility of toner particles in Specific Example 8.

FIG. 10 is a graphical representation of the relationship between the addition amount of a basic group-containing charge control agent and the mobility of toner particles. When a direct voltage was applied to the liquid developer, all of the particles (toner particles) in the liquid developer were quickly electrodeposited on the anode plate by electrophoresis and the liquid became transparent. This is because the polarity of toner particles was reversed to minus polarity by dispersing a basic group-containing charge control agent having the same polarity as the charge polarity of the toner particles into the insulating liquid. In addition, as shown in the figure, the mobility of the toner particles tends to increase as the addition amount of the basic group-containing charge control agent increases. Therefore, in the liquid developer of Specific Example 8, an increase in moving speed was confirmed, comparing with the liquid developer of Specific Example 5 free of basic group-containing charge control agent.

SPECIFIC EXAMPLE 9

180 parts by weight of dimethyl silicone, 17 parts by weight of colored particles, 1 part by weight of dimethyl aminomethyl methacrylate, 2 parts by weight of one-end methacryloxy-modified silicone, and 1 part by weight of azobisvaleronitrile were added in a reaction vessel attached with a thermometer and a nitrogen-introducing pipe, and the whole was mixed by agitation. Then, the mixture was reacted for 10 hours at 50° C. while being stirred in a stream of nitrogen. Subsequently, 30 parts by weight of the resulting toner particles as well as 2 parts by weight of zirconium octoate as a metal were added to 68 parts by weight of dimethyl silicone (100 cSt) as an insulating liquid and dispersed by an ultrasonic wave to obtain a liquid developer. Just as in the case of Specific Example 5 described above, the toner particles have outstanding characteristics of being hard to agglutinate with each other.

Figure 11:
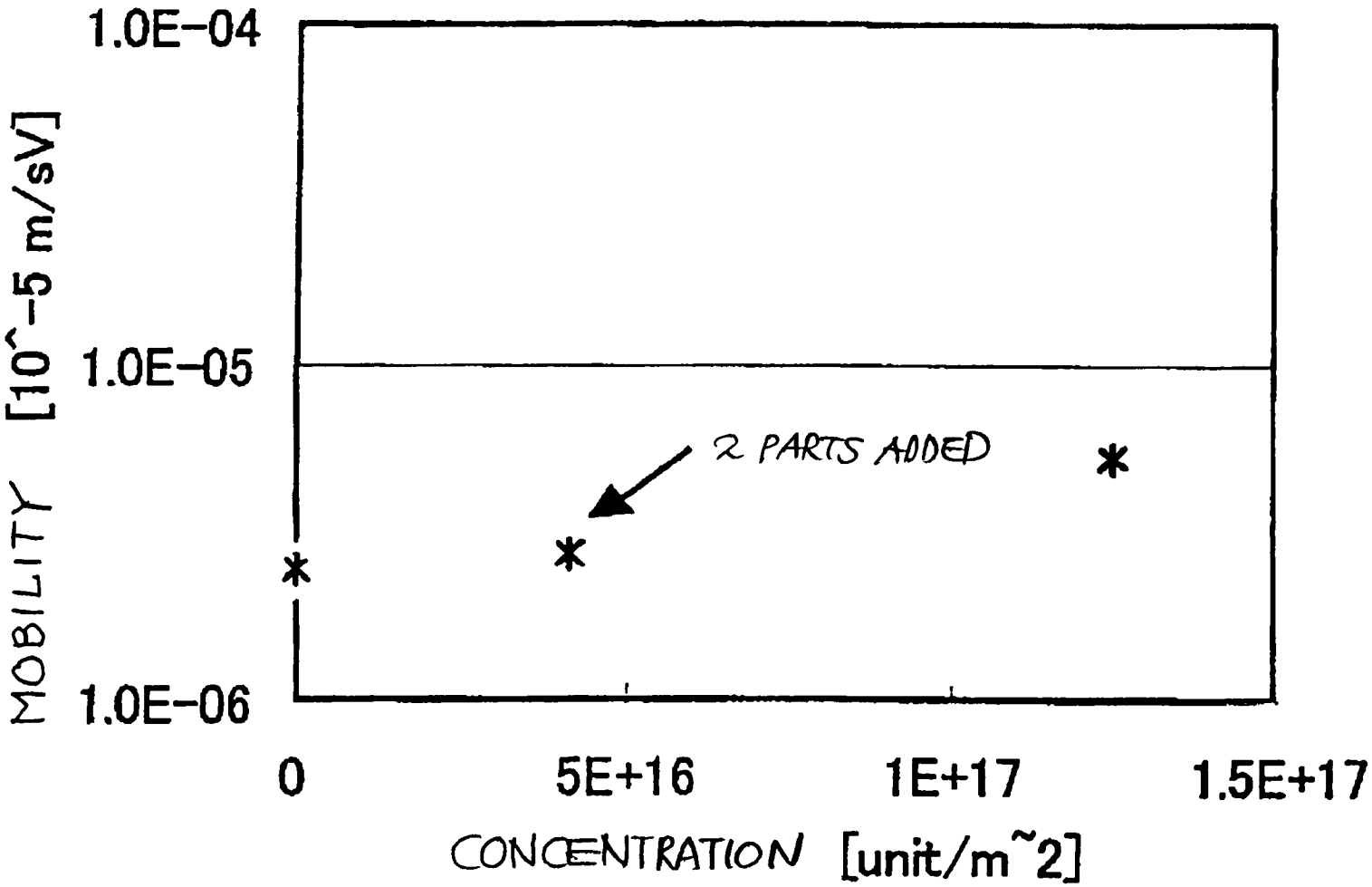
FIG. 11 is a graphical representation of a relationship between an addition amount of zirconium octoate and mobility of toner particles in Specific Example 9.

FIG. 11 is a graphical representation of the relationship between the addition amount of zirconium octoate and the mobility of toner particles. When a direct voltage was applied to the liquid developer, all of the particles (toner particles) in the liquid developer were quickly electrodeposited on the cathode plate by electrophoresis and the liquid became transparent. As shown in the figure, the mobility of the toner particles tends to increase as the addition amount of zirconium octoate increases. Therefore, in the liquid developer of Specific Example 9, an increase in moving speed was confirmed, comparing with the liquid developer of Specific Example 5 free of zirconium octoate.

SPECIFIC EXAMPLE 10

180 parts by weight of dimethyl silicone, 17 parts by weight of colored particles, 1 part by weight of methacrylic acid, 2 parts by weight of one-end methacryloxy-modified silicone, and 1 part by weight of azobisvaleronitrile were added in a reaction vessel attached with a thermometer and a nitrogen-introducing pipe, and the whole was mixed by agitation. Then, the mixture was reacted for 10 hours at 50° C. while being stirred in a stream of nitrogen. Subsequently, 30 parts by weight of the resulting toner particles as well as 2 parts by weight of a basic group-containing charge control agent were added to 68 parts by weight of dimethyl silicone (100 cSt) as an insulating liquid and dispersed by an ultrasonic wave to obtain a liquid developer.

Just as in the case of Specific Example 6 described above, the toner particles have outstanding characteristics of being hard to agglutinate with each other. In addition, when a direct voltage was applied to the liquid developer, all of the particles (toner particles) in the liquid developer were quickly electrodeposited on the anode plate by electrophoresis and the liquid became transparent. At this time, in the liquid developer of Specific Example 10, an increase in moving speed was confirmed, comparing with the liquid developer of Specific Example 6 free of basic group-containing charge control agent. The reason therefor is the same as that in Specific Example 7 described above.

SPECIFIC EXAMPLE 11

180 parts by weight of dimethyl silicone, 17 parts by weight of colored particles, 1 part by weight of methacrylic acid, 2 parts by weight of one-end methacryloxy-modified silicone, and 1 part by weight of azobisvaleronitrile were added in a reaction vessel attached with a thermometer and a nitrogen-introducing pipe, and the whole was mixed by agitation. Then, the mixture was reacted for 10 hours at 50° C. while being stirred in a stream of nitrogen. Subsequently, 30 parts by weight of the resulting toner particles as well as 30 parts by weight of an acidic group-containing charge control agent were added to 40 parts by weight of dimethyl silicone (100 cSt) as an insulating liquid and dispersed by an ultrasonic wave to obtain a liquid developer.

Just as in the case of Specific Example 6 described above, the toner particles have outstanding characteristics of being hard to agglutinate with each other. When a direct voltage was applied to the liquid developer, all of the particles (toner particles) in the liquid developer were quickly electrodeposited on the cathode plate by electrophoresis and the liquid became transparent. This is because the polarity of the toner particles was reversed to plus polarity by dispersing an acidic group-containing charge control agent having the same polarity as the charge polarity of the toner particles into the insulating liquid. In addition, the charge amount of the toner particles increases as the addition amount of the acidic group-containing charge control agent increases. Therefore, in the liquid developer of Specific Example 11, an increase in moving speed was confirmed, comparing with the liquid developer of Specific Example 6 free of basic group-containing charge control agent.

SPECIFIC EXAMPLE 12

180 parts by weight of dimethyl silicone, 17 parts by weight of colored particles, 1 part by weight of methacrylic acid, 2 parts by weight of one-end methacryloxy-modified silicone, and 1 part by weight of azobisvaleronitrile were added in a reaction vessel attached with a thermometer and a nitrogen-introducing pipe, and the whole was mixed by agitation. Then, the mixture was reacted for 10 hours at 50° C. while being stirred in a stream of nitrogen. Subsequently, 30 parts by weight of the resulting toner particles as well as 2 parts by weight of zirconium octoate as a metal were added to 68 parts by weight of dimethyl silicone (100 cSt) as an insulating liquid and dispersed by an ultrasonic wave to obtain a liquid developer.

Just as in the case of Specific Example 6 described above, the toner particles have outstanding characteristics of being hard to agglutinate with each other. In addition, when a direct voltage was applied to the liquid developer, all of the particles (toner particles) in the liquid developer were quickly electrodeposited on the cathode plate by electrophoresis and the liquid became transparent. At this time, in the liquid developer of Specific Example 12, an increase in moving speed was confirmed, comparing with the liquid developer of Specific Example 6 free of zirconium octoate.

SPECIFIC EXAMPLE 13

Isopar G was used as a substitute for dimethyl silicone as an insulating liquid in Specific Example 5. When a direct voltage was applied to the liquid developer, all of the particles (toner particles) in the liquid developer were immediately electrodeposited on the cathode plate by electrophoresis and the liquid became transparent.

As described above, the liquid developer according to this embodiment has following advantages:

(1) The toner particles can be more certainly dispersed when the liquid developer is charged with polarity opposite to the toner by the presence of a polar group.

(2) When a dispersion-facilitating substance having a carboxyl group or a hydroxyl group is sued as a polar group having polarity opposite to the toner, the toner can be finely dispersed, the crosslinking reaction can be facilitated, the toner particles can be hard to agglutinate, and the reaction rate of the crosslinking reaction can be increased.

(3) When methyl methacrylate or an acrylic polymer compound mainly composed of methyl methacrylate is used as a dispersion-facilitating substance, the agglutination at the time of polymerization can be avoided and fine self dispersion can be performed, and a polar group can be easily introduced.

(4) When a graft copolymer is used as an acrylic polymer compound, more definite dispersion performance can be obtained by favorably adsorbing the graft copolymer on the toner while allowing the graft copolymer to favorably float in the liquid.

(5) The dispersion performance of toner can be more favorably elicited using silicone oil as a nonvolatile liquid together with a graft copolymer containing silicone in its graft portion as the graft copolymer.

(6) When the graft copolymer used has an average molecular weight of 500 to 10,000, the affinity thereof to a nonvolatile liquid can be favorably exerted and also favorable dispersion performance can be exerted.

(7) When the nonvolatile liquid used is aprotic, the liquid is imposed to keep its electric resistance which does not disturb the electrophoresis of toner in an electric field to obtain good developing performance and transfer performance.

(8) When a liquid having an electric resistance of $1\times10^{12}\Omega\cdot$cm or more is used, poor development due to current leak between the toner particles can be suppressed.

(9) When a liquid having a surface tension of 30 dyne/cm is used, the deterioration of image quality such as scumming caused by adhesion of toner mass on a latent image carrier such as a photoconductive drum can be prevented

(10) When a silicone liquid that contains at least one of phenylmethyl siloxane, dimethyl polysiloxane, and polydimethyl cyclosiloxane is used as the liquid, the frequency of maintenance work on the device can be lessened.

(11) When the dispersion-facilitating substance used is a granular form, electrophoresis thereof can be favorably performed without resistance even in a high-viscosity liquid.

(12) The liquid developer contains toner particles provided as colored particles made of a resin and a colored substance; and a nonpolar insulating liquid to be used as a nonaqueous solvent for the toner particles. The liquid developer is provided for attaching toner particles on a latent image on the photoconductive drum provided as a latent image carrier to develop the latent image. As described above, furthermore, the liquid developer contains, on its surface, as toner particles: one-end methacryloxy-modified silicone provided as a dispersion-facilitating substance for inhibiting the agglutination between toner particles; and a silicone group provided as an affinity group for providing an affinity to an insulating liquid made of dimethyl silicone. Therefore, as described in Specific Example 5, toner particles become hard to mutually agglutinate in the insulating liquid and thus electrophoresis of the toner particles can be carried out at high speed by an electric field.

(13) As described in Specific Example 6, the liquid developer may use an acidic group in place of the basic group. In this case, the same effects as those of the basic group except its charge polarity can be obtained.

(14) An insulating liquid contains, together with toner particles, a charge control agent having compatibility to the insulating liquid and having an acidic group. Thus, when the toner particles have basic groups on their surface, the electrophoresis of the toner particles in the insulating liquid can be accelerated as described in Specific Example 7. On the other hand, when the toner particles have acidic groups on their surface, as described in Specific Example 11, it becomes possible to use the toner particles with their polarity inverted and also to accelerate the electrophoresis of the toner particles in the insulating liquid.

(15) An insulating liquid contains, together with toner particles, a charge control agent having compatibility to the insulating liquid and having a basic group. Thus, when the toner particles have basic groups on their surface, as described in Specific Example 8, it becomes possible to use the toner particles with their polarity inverted and also to accelerate the electrophoresis of the toner particles in the insulating liquid. On the other hand, when the toner particles have acidic groups on their surface, as described in Specific Example 10, it becomes possible to accelerate the electrophoresis of the toner particles in the insulating liquid.

(16) An insulating liquid contains, together with toner particles, a charge control agent having compatibility to the insulating liquid and having a metal. Thus, irrespective of whether the toner particles have basic groups or acidic group on their surface, the electrophoresis of toner particles in the insulating liquid can be accelerated as described in Specific Examples 9 and 12.

As described above, in accordance with the present invention, the use of a nonvolatile liquid solves the problem in that the generation of volatile gas complicates handling.

Also, in accordance with the present invention, uneven development density due to nonuniformity of dispersion of colored particles can be prevented by uniformizing the dispersibility of the colored particles in the liquid by the presence of a dispersion-facilitating substance.

Furthermore, in accordance with the present invention, a dispersion-facilitating substance being charged with polarity opposite to colored particles is mixed at a concentration of 0.05 to 20 parts by weight per part by weight of the colored particle, thereby allowing appropriate liquid amount control such that an appropriate amount of the liquid remains in a visible image at the transferring step while an excessive amount of the liquid does not remain in the visible image at the fixing step. Consequently, it is possible to prevent both the poor transfer caused by the shortage of the liquid and the poor fixation caused by an excess amount of the liquid. Therefore, there are excellent effects that solve each of the problems of uneven development density caused by uneven distribution of colored particles, poor transfer due to an insufficient amount of the liquid, and poor fixation due to an excess amount of the liquid, without complicating handling with the generation of volatile gas.

Various modifications will become possible for those skilled in the art after receiving the teachings of the present disclosure without departing from the scope thereof.

What is claimed is:

1. A liquid developer for developing a latent image on a latent image carrier, comprising:

colored particles comprising at least a resin and a colored substance, wherein the concentration of the colored particles in the liquid developer is 5 wt % to 40 wt %, wherein the colored particles are capable of being deposited on a latent image formed on an image carrier to develop the latent image;

a liquid having a viscosity of 10 to 1,000 mPa·S and serving as a dispersant for the colored particles;

wherein a substance having a polarity opposite to the polarity of the colored particles is contained in the liquid in a ratio of 0.05 parts by weight to 20 parts by weight to 1 part by weight of the colored particles as a dispersion-facilitating substance for facilitating dispersion of the colored particles in the liquid.

2. A liquid developer as claimed in claim 1, wherein the dispersion-facilitating substance has, on its surface, a polar group having a polarity opposite to the polarity of the colored particles.

3. A liquid developer as claimed in claim 2, wherein the dispersion-facilitating substance has at least one of a carboxyl group and a hydroxyl group as the polar group.

4. A liquid developer as claimed in claim 1, wherein the dispersion-facilitating substance has an average molecular weight of 1,000 or more.

5. A liquid developer as claimed in claim 1, wherein the dispersion-facilitating substance is one of methyl methacrylate (acryl) and a compound mainly composed of methyl methacrylate (acryl).

6. A liquid developer as claimed in claim 5, wherein the compound is a graft copolymer.

7. A liquid developer as claimed in claim 6, wherein the liquid is silicone oil and the graft copolymer has a graft portion containing silicone.

8. A liquid developer as claimed in claim 6, wherein the graft copolymer has an average molecular weight of 500 to 10,000.

9. A liquid developer as claimed in claim 1, wherein the liquid is an aprotic liquid.

10. A liquid developer as claimed in claim 9, wherein the liquid has an electric resistance of 1×1012Ω·cm or more, a surface tension of 30 dyne/cm or less, and a boiling point of 100° C. or more.

11. A liquid developer as claimed in claim 10, wherein the liquid is a silicone liquid that contains at least one of phenylmethyl siloxane, dimethyl polysiloxane, and polydimethyl cyclosiloxane.

12. A liquid developer as claimed in claim 1, wherein the dispersion-facilitating substance is of a granular form.

13. A liquid developer as claimed in claim 12, wherein the dispersion-facilitating substance has an average particle size of 0.001 to 1 μm.

14. A liquid developer as claimed in claim 1, wherein the colored particles have a volume average particle size of 0.1 to 6.0 μm.

15. A liquid developer as claimed in claim 1, wherein the colored particles have, on their surface, the dispersion-facilitating substance, a basic group, and an affinity group that provides an affinity to the liquid.

16. A liquid developer as claimed in claim 15, wherein the liquid contains, in addition to the colored particles, a charge control agent having compatibility to the liquid and having an acidic group.

17. A liquid developer as claimed in claim 15, wherein the liquid contains, in addition to the colored particles, a charge control agent having compatibility to the liquid and having a basic group.

18. A liquid developer as claimed in claim 15, wherein the liquid contains, in addition to the colored particles, a charge control agent having compatibility to the liquid and having a metal.

19. A liquid developer as claimed in claim 1, wherein the colored particles have, on their surface, the dispersion-facilitating substance, an acidic group, and an affinity group that provides an affinity to the liquid.

20. A liquid developer as claimed in claim 19, wherein the liquid contains, in addition to the colored particles, a charge control agent having compatibility to the liquid and having an acidic group.

21. A liquid developer as claimed in claim 19, wherein the liquid contains, in addition to the colored particles, a charge control agent having compatibility to the liquid and having a basic group.

22. A liquid developer as claimed in claim 19, wherein the liquid contains, in addition to the colored particles, a charge control agent having compatibility to the liquid and having a metal.

23. An image forming apparatus, comprising:

a latent-image bearing member; and developing means for developing a latent image on a surface of the latent image bearing member which contains the liquid developer of claim 1 to the latent-image.

* * * * *